US009616283B1

(12) United States Patent
Heineck et al.

(10) Patent No.: US 9,616,283 B1
(45) Date of Patent: Apr. 11, 2017

(54) THERAPEUTIC DEVICE

(71) Applicants: Bradley Allen Heineck, Holmen, WI (US); Gregory Carl Heineck, Holmen, WI (US)

(72) Inventors: Bradley Allen Heineck, Holmen, WI (US); Gregory Carl Heineck, Holmen, WI (US)

( * ) Notice: Subject to any disclaimer, the term of this patent is extended or adjusted under 35 U.S.C. 154(b) by 265 days.

(21) Appl. No.: 13/999,229

(22) Filed: Jan. 31, 2014

Related U.S. Application Data

(60) Provisional application No. 61/850,042, filed on Feb. 7, 2013.

(51) Int. Cl.
*A63B 21/00* (2006.01)
*A63B 22/20* (2006.01)

(52) U.S. Cl.
CPC ..... *A63B 22/203* (2013.01)

(58) Field of Classification Search
CPC ..... A63B 21/00
USPC ..... 482/54, 70, 74
See application file for complete search history.

(56) References Cited

U.S. PATENT DOCUMENTS

| | | | |
|---|---|---|---|
| 4,645,201 | A | 2/1987 | Evans |
| 4,684,121 | A | 8/1987 | Nestegard |
| 4,804,178 | A | 2/1989 | Friedabach |
| 4,948,121 | A | 8/1990 | Haaheim et al. |
| 5,690,590 | A | 11/1997 | Lo et al. |

*Primary Examiner* — Jerome W Donnelly
(74) *Attorney, Agent, or Firm* — M. Paul Hendrickson

(57) ABSTRACT

A low stress therapeutic device is provided by utilizing foot plates and guide rails having operationally tracking surfaces of a low coefficient of friction supported by a platform. The device includes a rail stabilizer equipped with extending longitudinally recess or slot and a slideably mounted foot plate having upon its underside a longitudinal projection slideably retained within the rail recess. The therapeutic device may be designed to operate under relatively effortless strain at a low coefficient of friction. The therapeutic device is useful for knee replacement, stroke victims, ACL repair, and other therapeutic treatments requiring a nominal initiating effort of movement for rehabilitation. The device may be provided as a one or two footed device of a light weight particularly useful in a patient sitting or lying position. The foot plates may be appropriately equipped with longitudinally underside tracking guides reciprocating sliding within longitudinal slots provided by a tracking rail.

21 Claims, 13 Drawing Sheets

THERAPEUTIC DEVICE

This application is a non-provisional application of provisional application Ser. No. 61/850,042 filed Feb. 7, 2013, bearing the same title as this application, the disclosure of which is incorporated herein and made a part of this non-provisional application.

FIELD OF INVENTION

The present invention relates to a therapeutic device and more particularly a therapeutic device for therapeutic treatment of body limbs and the use thereof.

BACKGROUND OF THE INVENTION

The prior art embraces hundreds of different leg exercise devices which basically involve foot plates (often referred to as carriages, foot pads, foot plates, etc.) which reciprocally track along an elongated track. Some of the devices are designed to place strain upon the exercising limps while others are designed to move more freely. For many therapeutic applications such as stroke victims, elder care knee replacements, ACL (anterior cruciate ligament) injuries, a free tracking movement is required initially until the patient strengthens the injuries and is capable of a more stressful movement. Track seated bearings, journals, or rollers, etc. have become common practice in order to provide a more free tracking movement for foot reciprocating devices.

U.S. Pat. No. 4,645,201 to Evans discloses, a cross-country ski simulating machine relying upon horizontally positioned tracks and foot pads equipped with a nylon friction tape to increase exercise resistance upon the foot pad movements. Similarly, U.S. Pat. No. 4,864,121 to Nestegard discloses foot pads equipped with rollers tracking upon rails and a friction creating accessory to create a desired exercising resistance level.

A ski simulating device relying upon foot plates underpinned by rollers seated within guide rails to ease tracking is disclosed in U.S. Pat. No. 5,690,590 to Lo et al. U.S. Pat. No. 4,804,178 to Friedabach discloses another cross-country ski exercising device which relies on rollers which track so as to inhibit transverse movement of the foot plates. U.S. Pat. No. 4,948,121 to Haaheim et al. and U.S. Pat. No. 4,645,201 to Evans disclose rollers slideably engaging along side rails instead of riding upon the guide rails.

It is evident as reflected by the patent literature that the prior art has taken various different approaches to create leg exercising devices primarily designed for the younger and more athletic exercisers. Unfortunately, none of these exercise devices are of a practical or commercially usable form for medical providers requiring specialized treatment and especially those for requiring low stress therapy treatment of the elderly and patients with leg joint injuries. Certain therapy necessities the least possible amount of strain to effectuate early stage joint movement such as applying the appropriate low strain therapy to repair a recently impaired joint as commonly arises with surgically knee joint replacements. A knee replacement patient will typically be subjected to a motor driven reciprocating (a continuous passive motion or CPM) foot slide in which the patient's knee replacement foot is forcibly moved therein shortly after surgery. This knee therapy can be very painful.

There exists a need for a low cost, effective, durable, sanitary and low stress leg therapeutic device which provides the necessary therapeutic efficacy under more effortless conditions. This is exemplified by a long felt need to apply effective therapeutic treatment for a damaged, injured, or surgical joint replacement. Therapeutic treatment as most commonly and currently used by hospitals and clinics to restore normal joint activity to damaged joints has remained virtually unchanged for decades. This is an exemplified by a knee replacement surgery which necessitates knee joint movement without undue stress as soon as possible following knee replacement surgery in order to effectively rehabilitate the artificial knee joint. A wide spread common therapeutic practice following the motorized forced knee movement therapy involves simply placing the patient's knee replacement foot onto a slideable material such as a paper sheet, towel, etc. and sliding the patient's foot backward and forward while the patient is seated. Notwithstanding a long standing need for a more sophisticated, reliable, and effective low stress therapeutic device procurable at a low cost, decades have since past without any substantive change in the available therapeutic rehabilitating devices for surgically related joint replacements and elder care rehabilitation. An alternative to the archaic therapeutic use of sliding paper or cloth upon an ordinary floor would represent a significant change in the standard therapy for knee replacement patients. A low stress therapeutic device adapted to standardize joint movement, the level of force required and avoidance of detrimental damaging stressful movements while also being effective in preventing accidental misuse by the patient would satisfy a long felt need. Although the aforementioned centers upon knee joint replacement therapy, therapeutic knee recover procedures are generally the same for most other knee injuries such as contusions, muscle tears, sprains, ACL repair, torn or partially torn ligaments, joint nerve damage, such as from stroke, other neurological disorders, etc.

SUMMARY OF THE INVENTION

The present invention provides a relatively inexpensive therapeutic exercising device providing effective low stress or low resistance therapeutic rehabilitating treatment for appendages. In general, the therapeutic device of this invention comprises at least one foot plate for slideably positioning a patient's foot thereupon. The foot plate slideably engages onto a guide rail in a forward and backward reciprocating motion. The therapeutic device is equipped with forward and rearward stops adaptable, if desired, with adjustable stops set to provide a desired stride or angular movement for an injured or damaged limb joint such as a knee joint. The foot plate slideably engages onto guide rails which are uniquely characterized as collectively providing slideable surfaces of a low coefficient of friction. The slide surfaces may be provided by materials yielding a low coefficient of friction or by the aid of a lubricant serving to further substantially reduce the coefficient of friction therebetween.

An important aspect of the invention relies upon slide engaging materials which provide a slippery surface. This becomes particularly important for those therapeutic uses wherein joint movement is essential while necessitating a minimal amount of muscular strain as a dominant rehabilitating criteria. This requires the use of foot plate and a guide track having sliding surfaces exhibiting an exceptionally low coefficient of friction value for the slideable engagement upon what is referred to as a tracking surfaces. Certain plastics (e.g. thermoplastics and thermosets), possessing or formulated to yield a low coefficient of friction as well as those fortified with effective slip agents, plasticizers etc. have been shown to be particularly effective for use as a foot plate construction material. Foot plates sliding surfaces constructed of materials exhibiting an operational coefficient of friction less than 0.1 may be made workable but significantly enhanced efficacy is achieved if less than a 0.07 coefficient of friction is provided. In general, plastic materials exhibiting exceptional therapeutic treatment efficacy for use as a foot plate slide surface herein may be found within a class of polymeric materials often referred to as a high density (e.g. high molecular weight polymers) thermoplastics exhibiting a coefficient of friction of less than 0.06. In general, the least amount of friction generated between the foot plate and guide rail sliding surfaces affords the highest order of therapeutic efficacy for many specialized treatments. These coefficient of friction levels may be achieved by using contacting slide surfaces possessing low coefficient of friction values per se or in operational combination with a lubricant to sufficiently reduce the coefficient of friction to an acceptable level.

The foot plate and guide rail may be appropriately supported by a support platform for emplacement at the therapeutic use site. The device may be equipped with one or more foot plates. The therapeutic device may be effectively utilized for a host of therapeutic applications necessitating an extremely low level of force to move an appendage joint. In many therapeutic applications, effortless motion rather than force is required. The therapeutic device may accordingly be appropriately utilized by knee replacement, ACL repair, stroke, etc. patients using the device either in a desired seated or lying position. Simply by freely sliding the patient's foot or other appendages thereupon in a backward or forward motion, enhanced recovery may be accomplished. For example, knee replacement patient's recovery may thereby be effectively achieved at a desired minimal force level for movement while still providing the optimum therapeutic treatment for the patient. Due to the unique attributes of the present therapeutic device, therapeutic knee replacement treatment, ACL repair, stroke, and sprained knee may commence therapy before the patient is medically capable or recovered sufficiently to be placed in the seated position. This illustratively allows for use of the present therapeutic device by a bed ridden patient shortly after knee surgery or injury instead of being forced to use the cumbersome and often painful CPM knee joint treatment. A bed ridden patient may accordingly rehabilitate the replaced knee joint at a comfortable pace, without placing premature and undue external strain upon the patient's injured knee. The device affords a uniquely different treatment for patients having an immobilized leg such as often occurs with stroke victims.

DETAILED DESCRIPTION OF THE INVENTION

Figure 10:
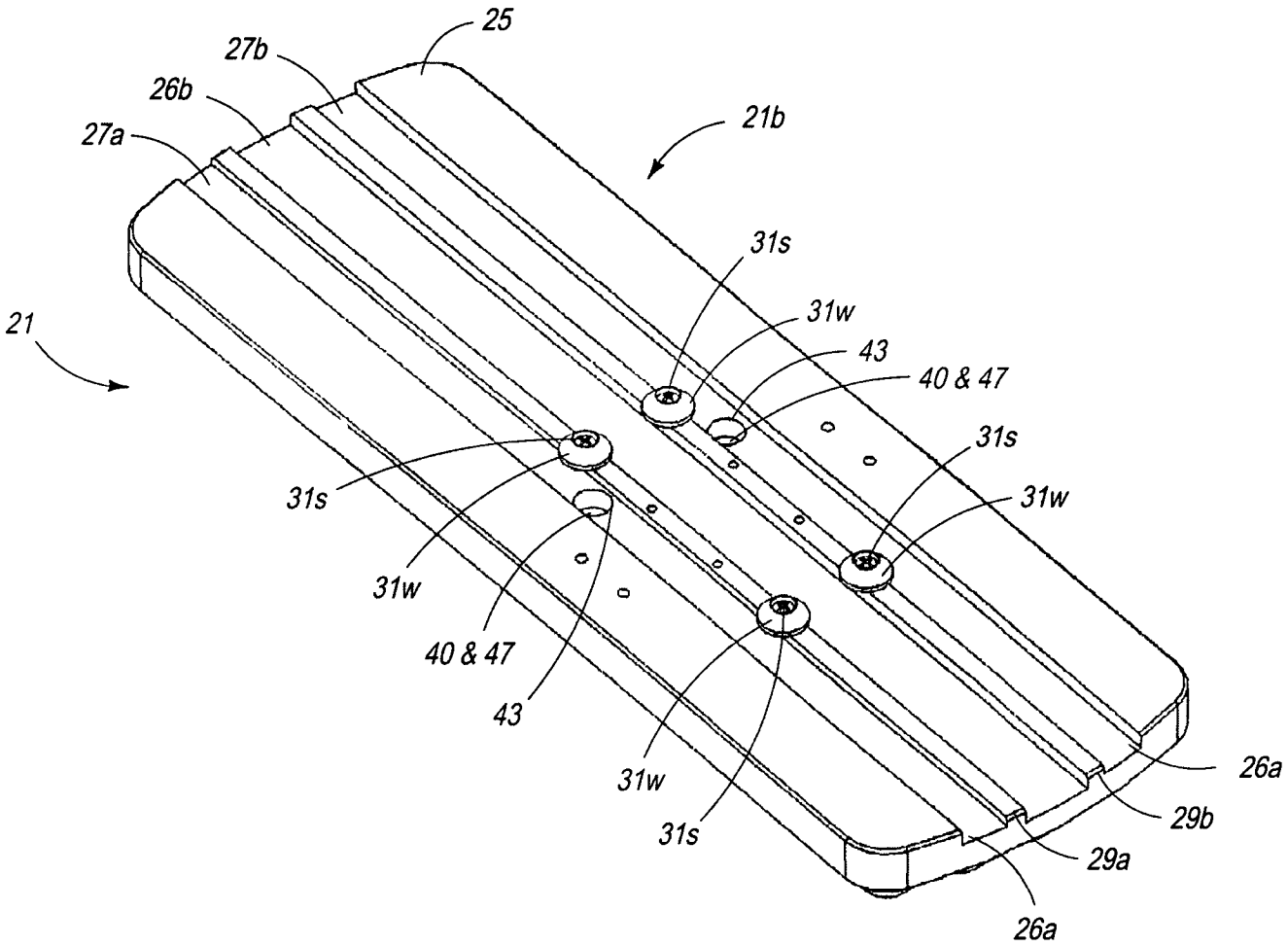
FIG. 10 is a bottom view of a foot plate partially shown in FIGS. 2 and 8-9.
Figure 11:
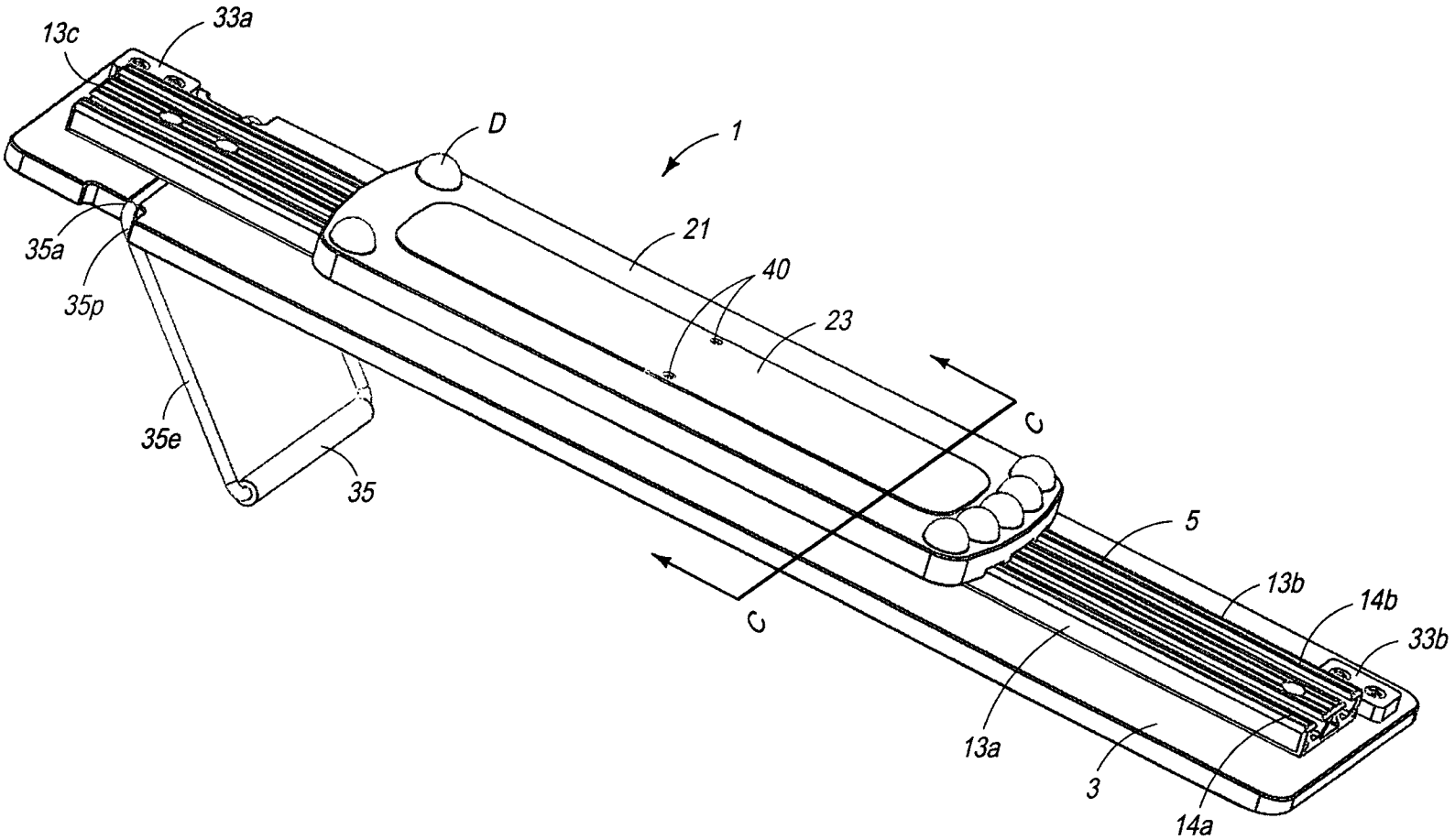
FIG. 11 is a side view of an elevated mono foot plate therapeutic device of this invention.
Figure 12:
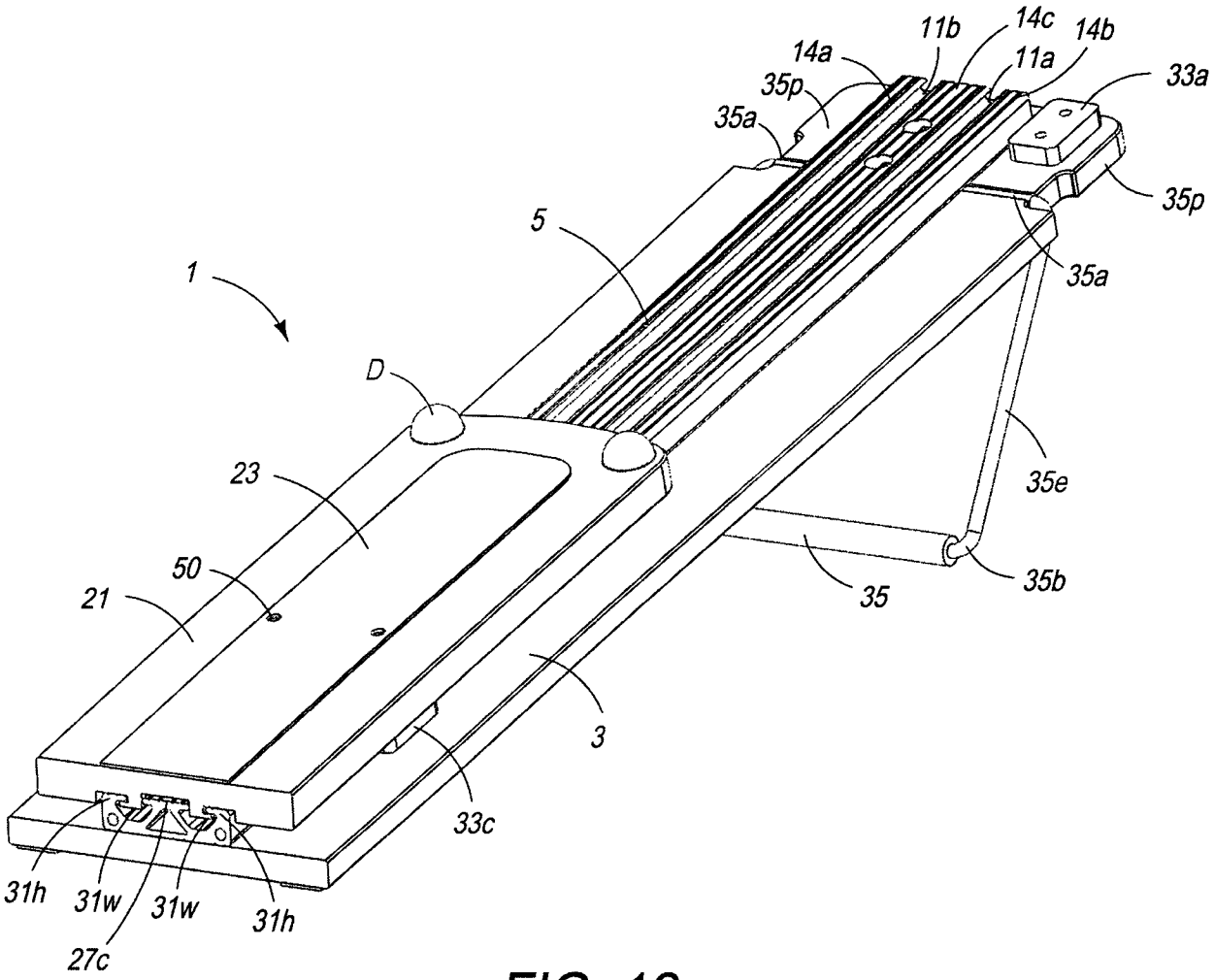
FIG. 12 is a cross-sectional view taken along lines C-C of FIG. 11.
Figure 13:
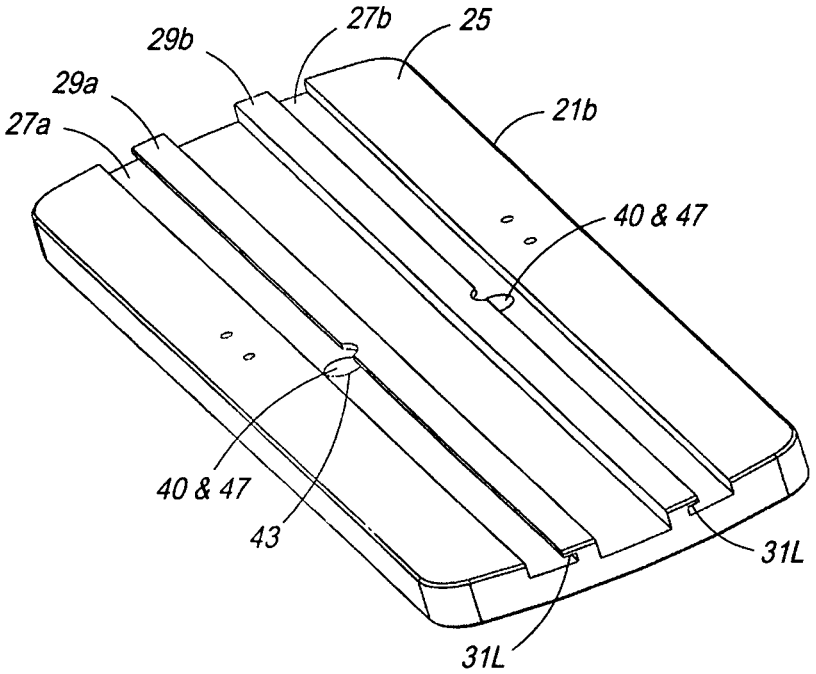
FIG. 13 is an underside isometric view of the foot plate of FIG. 11.

With reference to the accompanying Figures (including reference to the provisional application Figures and Photographs), the present invention provides a therapeutic device 1 adapted to provide a minimal level of movement resistance to a therapeutic patient using the device 1. The therapeutic device 1 comprises:

A) a support platform 3 for supporting the device 1,

B) a guide rail 5 securely mounted to the support platform 3, with the guide rail 5 having one or more longitudinally aligned guide slots (e.g. 11*a* & 11*b*) separated by a flanged center rail 13*c* with each of said guide slots 11*a* & 11*b* bordering onto outer flanged slide guides 13*a* & 13*b* (e.g. see FIGS. 2-3, 6-9 and 11-12) wherein slots 11*a* & 11*b* longitudinally extend along the guide rail 5 with said guide slots 11*a* & 11*b* in combination with flanged guides 13*a* & 13*b* and the flanged center guide 13*c* providing a hollow housings or cavity 15*h* (e.g. see FIGS. 2, 8-9, 12 and 14) for retaining a rail retaining member 31 therewithin, C) at least one foot plate 21 for placing an appendage of a therapeutic patient thereupon with said foot plate 21 and having a foot plate underside (generally referred as 25 as shown in FIGS. 10 and 13) equipped with one or more channeled beds (prefixed by 26) having a recessed slide surface 27 (depicted as recessed slide surfaces 27*a* & 27*b*) for slideably tracking upon interfacing rail surfaces 14*a* & 14*b* of the flanged slide guides 13*a* & 13*b*, one or more longitudinally tracking member (e.g. ribs 29*a* & 29*b*) slideably housed within the guide slots 11*a* and/or 11*b* serving to maintain a longitudinal tracking of the foot plate 21 along the guide rail 5 as the foot plate 21 reciprocates thereupon and a foot plate retaining member 31 which in operational use of the foot plate 21 serves to retain the foot plate 21 within each of the hollow housings 15*h* of the guide rail 5; and D) a reciprocating movement stop (generally referenced as 33 shown in FIGS. 1, 3, 6-9, 11-12, and 15-16) for stopping foot plate 21 movements typically with a forward stop 33*a* stopping forward movement and a rearward stop 33*b* stopping rearward movement of the foot plate 21.

A foot plate stop 33*c* mounted to an underside 25 of the foot plate 21 (shown in FIGS. 10 and 12) serves to stop each foot plate 21 upon contact of foot plate stop 33*c* with forward stop 33*a* and rearward stop 33*b*. The positioning of movement stops 33 may be positionally changed so as to allow for a longer or shorter foot plate strides to be effectuated upon rail 5.

The interfacial contacting rail surfaces 14*a* & 14*b* provided by flanged slide guides 13*a* & 13*b* and the interfacing underside foot plate slide surface or surfaces thereto (generally referred as 27) provided by foot plate channels 26*a* & 26*b* may be appropriately established by the channeling or routing channeled slide surfaces 27*a* & 27*b* within the foot plate underside 25 at an appropriate depth and width for establishing the desired corresponding contact recessed slide surface 27*a* & 27*b* onto the contacting rail surfaces 14*a* & 14*b*. These interfacing surfaces (27*a* & 14*a*, and 27*b* & 14*b*) operationally constitute a desirable weight bearing surface slideably engaging onto guide rail surfaces 14*a* & 14*b* of flanged slide guides 13*a* & 13*b*. With particular reference to FIGS. 2, 8-9, 12 and 13, the depicted guide rail 5 includes three basic top flanged surfaces 13*a*, 13*b*, & 13*c* operationally in juxtaposition to the foot plate underside 25, all of which surfaces are shown as being of an identical vertical height. However, the foot plate 21 when slideably tracking upon at its interfacing slide surfaces 27*a* & 27*b* only utilizes the outer two flanged guide rail surfaces 14*a* & 14*b* of guide rail flanged sections 13*a* & 13*b* as the basic weight bearing contacting sliding surface which interfacially contacts with the foot plate sliding surfaces 27*a* & 27*b* of foot plate 21. These features enhance patient foot and leg stability upon the rails 5*a* & 5*b* while also effectuating the desired low coefficient of friction level to reduce muscular strain and optimize low stress rehabilitation. The use of two or more guide slots (e.g. 11*a* & 11*b*) as well as two or more interfacing foot plate sliding surfaces (e.g. 27*a* & 27*b*) operationally engaging guide rail slide surfaces (e.g. 14*a* & 14*b*) significantly contributes to stabilizing a patient's balance when using the device 1. Increasing the interfacing surfaces (27*a* & 14*a*, and 27*b* & 14*b*) to three or more contacting surfaces can increase the coefficient of friction.

The Figures appropriately depict the therapeutic device 1 of this invention by depicting various basic operative components of the therapeutic device 1. As may be observed from FIGS. 1-9, 11 and 14-15, the device 1 includes a supportive platform or base support 3 which supports one or more guide rails 5 equipped with one or more foot plates (generally referenced as 21) which retainingly and slideably engage onto at least one rail 5. Multiple rail interfacial tracking, however, significantly enhances stabilization of foot plate 21. Each foot plate 21 may appropriately carry a stop block 33*c* which reciprocates with the foot plate 21 in a forward and rearward reciprocating motion until stopped by a forward block stop 33*a* and a rearward block stop 33*b* (such as illustrated in FIGS. 3, 5, 6-7, 11 and 14-15). If desired, a single stop 33 positioned at the desired stopping position of the foot plate 21 for each rail 5 may also be used. The leading rearward and forward edge of the foot plate 21 would thereby serve as a stop 33*c* which upon contact with forward stops 33*a* & 33*b* positioned at a desired stopping position. An adjustable stride may be provided by the device 1 by the particular positioning of stops 33.

The device 1 necessarily includes interfacing rail contacting foot plate sliding surface (generally prefixed as 27) and rail contacting surfaces (generally prefixed as 14) supported by guide rail 5 operationally fulfilling certain coefficient of friction prerequisite values. As may further be observed from Figures, the therapeutic device 1 is desirably provided as a compact low profile structure which despite its compactness provides a surprisingly low stress therapeutic device 1 due in part to its unique mode of operation. The device 1 may suitably made of diverse lightweight materials which makes the device 1 easily toted by a health care provider or a patient at an exercising or clinical site or for home use as illustrated by FIGS. 3-4 and 6-7. Although particular emphasis herein is made of its usefulness for leg exercises, the device 1 broadly applies to exercising other appendages including both legs and arms and especially useful in exercising all of the appendage joints.

A host of materials may be used in the basic construction of guide rails 5. Any solid material (e.g. metal, plastics, wood, etc.) possessing sufficient structural strength to support the patient's weight can be used provided the guide rail contacting surfaces 14 or its surface in combination with the foot plate sliding surface 27 does not excessively increase the coefficient of friction. The aluminum guide rail 5 depicted and described herein is commercially available at hardware stores, home improvement stores and outlets which rail provides excellent therapeutic results especially when used in combination with other commercially available high molecular weight plastic foot plate materials or other suitable materials which collectively provide in combination with rail 5 a prescribed low coefficient of friction. The guide rails 5 may be typically manufactured by extruding, routing, molding, or any other manufacture suitable in providing the desired guide rail 5 structure. Molding or extruding a plastic material (e.g. thermoset or thermoplastic) possessing a prescribed low coefficient of friction as integral extrude structure or molded product can also provide an effective guide rail 5 product provided it possesses sufficient durability. The guide rail 5 as depicted herein when combined with a suitable foot plate 21 material yielding the desired low coefficient of friction values provides an exceptionally effective therapeutic device 1. The surprising factor resides in how low the coefficient of friction values herein may be achieved by the device 1.

The source of the commercially available slide rails 5 shown in the Figures and used in the Example 1 coefficient of friction test was manufactured by 80/20 ® Inc., 1701 South 400 East, Columbia City, Ind. 46725 and distributed by a John Henry Foster, 3103 Mike Collins Drive, Eagen, Minn. 55121. The depicted rail 5 (e.g. see FIGS. 1-2, 8-9 and 11-12) was of an extruded aluminum construction having the dimensional size as depicted in the engineering drawings of our provisional application. Due to its commercial availability, light supportive stabilized structure and low coefficient of friction values when properly combined with an effective low coefficient of friction foot plate 21 the invention provides a highly effective therapeutic device. Other types of guide rails 5 functioning in a same manner to produce the same result, but constructed of different materials and design may also be used in the construction of an appropriate guide rail 5 and foot plate 21.

In preparing the foot plate 21, the recessed slide surfaces (generally prefixed by 27) may be made by channeling the foot plate underside 25 foot plate channels 26*a* & 26*b* having recessed slide surfaces 27*a* & 27*b* at an appropriate depth, width, and lateral positioning so that only the recessed channeled slide surfaces 27*a* & 27*b* created within the foot plate 21 underside consist essentially of the sole contacting sliding surface or engaging surfaces with the guide rail, rail slide surfaces 14*a* & 14*b* of the flanged rail sections 13*a* & 13*b*. Therapeutic devices 1 equipped with two outwardly positioned rail and foot plate 21 contacting surfaces (e.g. 14*a* & 14*b* and 27*a* & 27*b*) supported by flanged slide guides 13*a* & 13*b* as depicted by the Figures offer particularly effective foot stability to each reciprocating foot plate 21 while also contributing to enhanced therapeutic performance. The balance of the foot plate 21 underside will normally be operatively positioned at a lower elevation than slide surfaces 27*a* & 27*b* which solely contact rail surfaces 14*a* & 14*b* thereby avoiding contact therewith which factors serve to further reduce frictional forces as well as stabilizing the reciprocating foot plate 21 upon rail 5.

Figure 14:
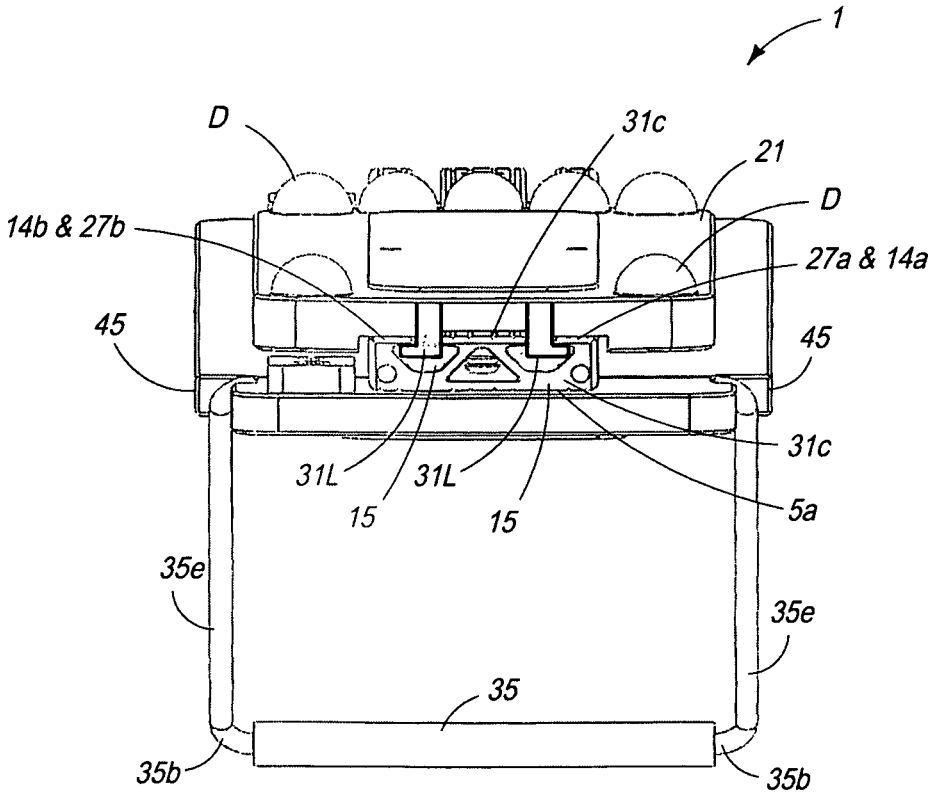
FIG. 14 is a frontal view of the therapeutic device shown in FIG. 11.

As shown in FIGS. 2, 8-9, 12 and 14, the foot plate 21 underside juxtapositioned to center flange 13*c* may be appropriately channeled deeper in depth so that only recessed slide surfaces 27*a* & 27*b* constitute the sole contacting slide surface 27 served by rail 5. The engineering prints accompanying our provisional application provide more detailed information on the foot plate underside 25 engineering specifications which were derived by fabricating modifications to a flat plastic sheet (e.g. a router equipped with conventional wood routing attachments) to provide the desired attributes of the foot plate sliding surface 14*a* & 14*b* and the foot plate tracking ribs 29*a* & 29*b*. A foot plate retaining member 31 created by routing techniques may also be integrated onto tracking ribs 29*a* & 29*b* structure as depicted by FIGS. 13 and 14. In the channeling (e.g. by the router) the recessed slide surfaces 27*a* & 27*b*, the channeling sidewalls and bed of foot plate channels 26*a* & 26*b* thereof are appropriately cut with sufficient clearance so as to provide a freely slideably margin along the peripheral side edges of flanged guides 13*a*, 13*b* & 13*c* so as to thereby avoid operationally contact except when infrequently need for longitudinal stabilization of the rail tracking foot plate 21. This may be accomplished by channeling the width of the recessed slide surface channels 26*a* & 26*b* at a slightly greater width than the width of the flanged guides 13*a* & 13*b*.

As depicted by FIGS. 10 and 12, the foot plate underside 25 may also be appropriately equipped with one or more tracking ribs (generally referred or prefixed as 29) which are also sized to freely slide within the confines of a guide slot 11 (e.g. slots 11*a* & 11*b*) as depicted in more detail by the FIGS. 8-10 and 12-13. The tracking ribs 29*a* & 29*b* are positioned at a higher underside elevation than the recessed guide surfaces 27*a* & 27*b* and sized so to freely slide within guide slots 11*a* & 11*b* as the foot plate 21 reciprocally slides along guide rail 5. When the retaining member 31 is routed into the rib structure, ribs 29*a* & 29*b* are appropriately fabricated to internally penetrate sufficiently within each rail cavity 15*h* to impart sufficient structural strength for retaining member lip 31L while also allowing lip 31L to clear the internally disposed overhang of flanged section 31*h*. The laterally disposed and parallel ribs 29*a* & 29*b* will accordingly track freely within guide slots 11*a* & 11*b*. Similar to the recessed guide surfaces 27*a* & 27*b*, the tracking ribs 29*a* & 29*b* are also slightly undersized in width from that of the slotted guide slots 11*a* & 11*b* so as to freely slide therewithin and provide longitudinal stability against lateral movement of the foot plate 21 as it reciprocates along the rail 5 while also taken into account sufficient clearance between retaining lip 31L and internally disposed rail flanged section 31*h*. The combination of longitudinal ribs 29*a* & 29*b* and guide slots 11*a* & 11*b* effectively serves to prevent unsafe lateral side movement of the foot plate 21 during therapeutic use and stabilize the longitudinal alignment and reciprocal tracking of the foot plate 21 while retaining lip 31L retains foot plate 21 for operationally tracking within guide rail 5. The tight, but non-contacting relationship between the channeled recessed slide surfaces 27*a* & 27*b* and flanged guides 13*a* & 13*b* also serves a similar stabilization purpose.

The sliding slide surfaces 14 of guide rail 5 in combination with recessed foot plate sliding surface 27 (27*a* & 27*b*) appropriately provide a sufficiently low coefficient of friction so that each foot plate 21 will freely slide thereupon at a prerequisite low coefficient of friction. This coefficient of friction is operationally maintained at a value of less than 0.10. Polished metal surfaces as well as other metallic surfaces of a low coefficient of friction may generally be applied to the therapeutic device 1 herein. The depicted aluminum flanged slide guide surfaces 14 supported by the outer guide rail flanges 13*a* & 13*b* provide a substantially rigid and linear travel surface upon which the recessed slide surfaces 27*a* & 27*b* track while also contributing to longitudinal stability. The foot plate recessed slide surfaces 27 and the flanged guide rail slide guide surfaces 14 may each be of a unitary single piece construction; (i.e. each of the same material of construction). Conversely the foot plate slide surfaces 27 and the rail slide guide surfaces 14 may consist of two interfacing low coefficient of friction strips or inlays secured to the guide rail flanged surfaces 14 (14*a* & 14*b*) or the underside of the slide guide surfaces 27 (e.g. 27*a* & 27*b*). A guide rail 5 having a flanged slide surface 14 possessing a higher coefficient of friction may be used provided it is fully compensated by a foot plate slide surface 27 of a sufficient low friction valve or an added lubricant meeting the necessary coefficient of friction requirements herein and vice versa.

In general, effective joint rehabilitation may be accomplished by maintaining the coefficient of friction values of the sliding foot plates 21 at less than 0.1 with particularly enhanced efficacy being accomplished by using contacting slide surfaces 14 & 27 having a coefficient of friction of less than 0.7. Illustrative devices affording excellent efficacy attributes for the therapeutic device 1 are those foot plates 21 having slide engaging surfaces (14 & 27) exhibiting a coefficient of friction falling within a range ranging from about 0.01 (or less if available) to less than about 0.06.

The longitudinally extending guide slots 11*a* & 11*b* in combination with the longitudinally aligned tracking ribs 29*a* & 29*b* also provide significant longitudinal stabilization as the foot plate 21 reciprocates along guide rail 5. Although the tracking ribs 29*a* & 29*b* are machined to slide freely within slots 11*a* & 11*b*, the tolerance gap therebetween should be positioned sufficiently close in clearance to inner edges or slot bordering onto the flanges of rail guides 13*a*, 13*b* & 13*c* to provide the desired longitudinal stability. Since the flanged slide guide 13*a* & 13*b* in combination the channeled slide surfaces 27*a* & 27*b* contribute substantial longitudinal stability, the coaction therebetween further enhances stabilization of the foot plate 5. In the event the tracking ribs 29*a* & 29*b* should occasionally brush against the edges of flanged rail guides 13*a* & 13*b* bordering guide slots 11*a* & 11*b*, the manufacture of ribs 29*a* & 29*b* constructed of the same low coefficient of friction values as the channeled slide surfaces 27*a* & 27*b* helps in maintaining the desired slideability attributes to the sliding foot plate 21. Since there exist plastic materials possessing all of the desired attributes including the desired coefficient of friction values, durability, wearability, machinability or fabrication qualities, rigidity, strength and foot plate 21 size, such plastic materials of a desired size offer an excellent material for the manufacture of the foot plates 21 herein.

The retaining unit (prefixed by 31) is generally a combination of retaining members 31 attached to both the foot plate 21 and the rail 5. For illustrative purposes, the rail part of the retention unit 31 is designated as 31*h* and often referred to as the flanged section retaining member 31 rail or lip retaining member. Two foot plate retaining members 31 are designated for illustrative depiction purposes as 31L for a lipped retainer and 31*w* for a washered retainer even though they both essentially function in a similar manner to produce essentially the same result.

In order to prevent separation of the foot plate 21 from the guide rail 5, a foot plate retaining member 31 serves to maintain the foot plate 21 from disengaging from the guide rail 5. The retaining member 31 is accordingly carried, in part, by the foot plate 21 and in part by the guide rail 5. With particular reference to FIGS. 2, 7-9, 12 and 14, the depicted ability of the retaining unit 31 combination to retain foot plate 21 to guide rail 5 relies in part upon a cavity or open housings 15*h* of rail 5 and one or more overhanging lips or rail 31L (flanged retaining section) provided by the flanged sections 13*a*, 13*b* & 13*c* which collectively with the foot plate retaining member 31 (31L & 31*w*) prevent any substantial outwardly separation of the foot plate 21 from guide rail 5. In order to be effective, the rail retaining member 31 should provide sufficient overhanging structure (e.g. 31*h*) to retain the foot retaining member 31 (e.g. lip 31L or washers 31*w*) and prevent foot plate 21 separation. The foot plate retaining member (e.g. 31L or 31*w*) will typically be positioned with sufficient clearance from the overhanging housing lip 31*h* so as not to significantly contribute to an increase in friction. In assembly of the foot plate 21 to the device 1 accessing to the depicted rail cavity housing 15*hh* is typically achieved by inserting the foot plate 21 equipped with the retaining member 31 through an open end of guide rail 5 before any closure thereof. This may typically be accomplished with the track closures created by either the forward stops 33*a* or rearward stops 33*b* being unsecured to the assembly until after tracking ribs 29*a* & 29*b* equipped with the foot plate retaining member 31 are properly inserted into rail housing 15*h*. The depicted retaining member 31L may be integrated into the fabrication of the foot plate 21 which provides retaining member 31L as an integral component of guide ribs 29*a* & 29*b* as illustrated by FIG. 12. Improved efficacy, performance and durability are generally accomplished when the retaining member 31L integrated to the longitudinal guide ribs 29*a* & 29*b* structure (or constituting the interfacing surface) or as later indicated the washered portion of retaining member 31*w* are constructed of the same low coefficient of friction material as guide surfaces 27*a* & 27*b*.

Certain plastic materials possessing the desired characteristics herein when used in the manufacture of the foot plates 21 significantly improve the operational efficacy of the device 1. Although not necessary, the foot plate 21, the guide rail 5 and retaining member 31 may be fabricated from the high density polyethylene material possessing exceptional low friction efficacy. The clearance between the non-interfacing rail 5, foot plate 21 and retaining member 31 components becomes of less concern if the fabricated components collectively possess exceptional low coefficient of friction values. However, the use of the low profile aluminum guide rails 5 as described herein provides excellent therapeutic results especially when combined with the best low coefficient friction performing plastic foot plates 21. Although any suitable rail retaining member 31 which retains the foot plate 21 in slideable engagement with the guide rail 5 (shown by FIGS. 2, 8-9 and 11) may be used, the flanged overhangs of 13*a*, 13*b*, & 13*c* supporting an internally disposed lip 31*h* of the depicted guide rail 5 provides a highly functional hollow structured housing 15*h* serving structurally as an excellent rail retaining member 31*n* for operational use in combination with the foot plate retaining member 31 (e.g. 31L or 31*w*).

As may be observed from comparing FIGS. 2, 8-10 and 12 with FIGS. 13 and 14, the depicted washered screws 31*w* bridge beneath two flanged sections 31*h* on each side of rail slots 11*a* & 11*b*. From a manufacturing viewpoint it is easier to mold, machine or extrude foot plates 21 equipped with the longitudinal tracking ribs 29*a* & 29*b* without the retaining lip 31L being integrated into the single piece foot plate 21 structure. As pointed out in our provisional application the washered retaining members 31*w* may be secured to tracking ribs 29*a* & 29*b* with screws 31*s* to provide a retaining member 31 bridging beneath all of the flanged overhangs 13*a*, 13*b* & 13*c* of guide rail 5. Since washers 31*w* bridge between both housed flanges 31*h* on each rail guide slot 11*a* & 11*b*, this feature further contributes to retention and stabilization of the foot plates 21 on rail 5.

Thus it may be further observed from the underside and cross-sectional foot plate 21 views of FIGS. 2, 8-10 and 12 that the washered screws 31*w* bridge across and beneath the rail retaining member 31*h* maintain the foot plate 21 within the guide rails 5 in contrast to the integrated single foot plate lip 31L shown in FIGS. 13-14 depicts the foot plate lipped retaining member 31L lips only one rail retaining flange 31*h*. When used, the number of washered screws 31*w* should be sufficient to maintain the foot plate 21 in operational position upon the rails 5. The number may vary with four washered set screws 31*s* namely two for each rib 29*a* & 29*b* for tracking within slots 11*a* & 11*b* is generally being sufficient for this purpose.

The retaining washers 31*w* may appropriately be constructed of the same low coefficient of friction material as used in the construction of the foot plates 21. In its assembly the washered set screws 31*w* are also inserted into the rail housing 15*h* in the same manner as the foot plates 21 equipped with the molded lip 31L. By injection molding the washer portion of washered retaining member 31*w* the injection molded washer may be sized to fit within rail slots 11*a* & 11*b* with a stem and mushroom shaped top sized to bridge beneath rail retaining member 31*h* with center screw bore provided therein for attachment to ribs 29*a* & 29*b*. The washered set screws 31*w* are screwed onto the bottom of tracking ribs 29*a* & 29*b* to provide a foot plate retaining member 31*w* spanning the underside lipped flanged 31*h* of flange section 13*a*, 13*b* & 13*c* of guide rail 5. Other retaining members 31 serving to retain the foot plate 21 in operational contact with Tail 5 may also be used for this purpose.

Other types of retaining members 31 may be used for more effective retaining means in retaining the foot plate 21 to the guide rail 5. In essence the combination retaining members 31 cooperatively provided by the rail 5 and the foot plate 21 generally embraces those retaining members 31 which function in a similar manner to produce essentially the desired retention of foot plate 21 to rail 5. The retaining members 31 combination will necessarily prevent substantial upward movement the foot plate 21 and separation from guide rail 5.

With particular reference to the FIGS. 1-3, 6-9, 11-12 and 15-16 depicting stops 33 for reciprocally stopping foot plate 21 movement, the forward and rearward movement of foot plate 21 may be stopped by any appropriate stopping members (generally prefixed by 33). This may be accomplished by forward and rearward stops (33*a* & 33*b*) mounted to platform 3 within the rail slots 11*a* & 11*b*. As depicted in the Figures, each foot plate 21 may also be appropriately equipped with foot plate stop 33*c* which in combination with the forward stop 33*a* and the rearward stop 33*b* stops the forward and rearward reciprocating movement of foot plate 21 upon guide rail 5 at a desired stride length. The longitudinal length and the positioning of foot plate stop 33*c* and the rail positioning of forward and rearward stops 33*a* & 33*b* accordingly controls the stride movement of foot plate 21 upon guide rail 5. To accommodate the various different patient strides or gait, adjustable stops 33*a*, 33*b* & 33*c* (may be visualized by the stop mounts in the Figures) can be appropriately incorporated into the guide rail 5 and the foot plate 21 structure by adjusting the positioning of adjustable foot stops 33*a* & 33*b* upon the platform 3 or rail 5 or an adjustable positioning of foot stop 33*c* carried by foot plate 21. Adjustability may also be achieved simply by mounting the stop plate screws at a different position. The more durable and effective stops 33 are provided by securely mounted forward 33*a*, rearward 33*b* and foot 33*c* stops in the form of block stops as opposed to other types of stops such as screw stops etc.

Figure 1:
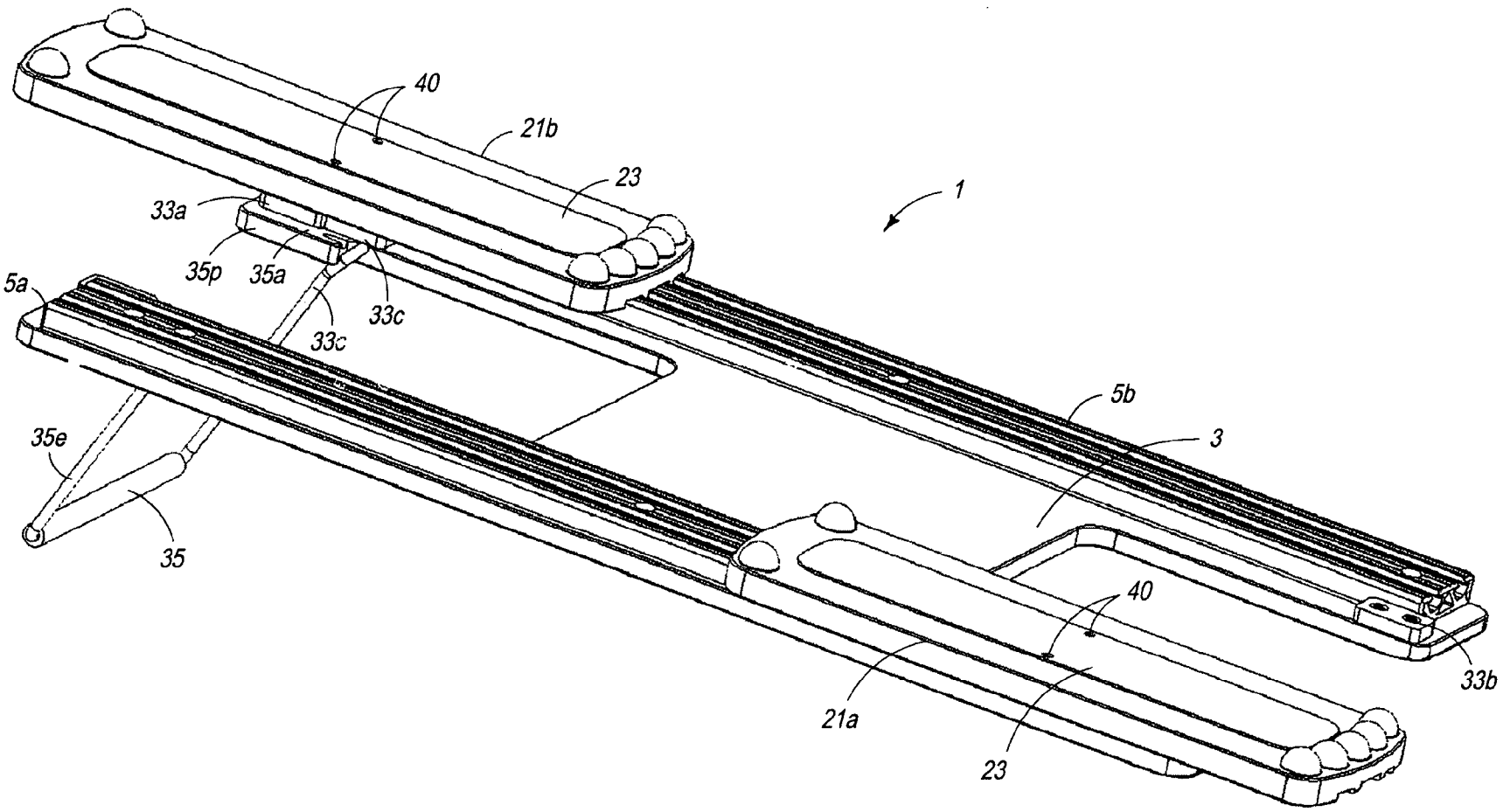
FIG. 1 is an isometric side view of the therapeutic device of this invention positioned at an elevated exercising position.
Figure 2:
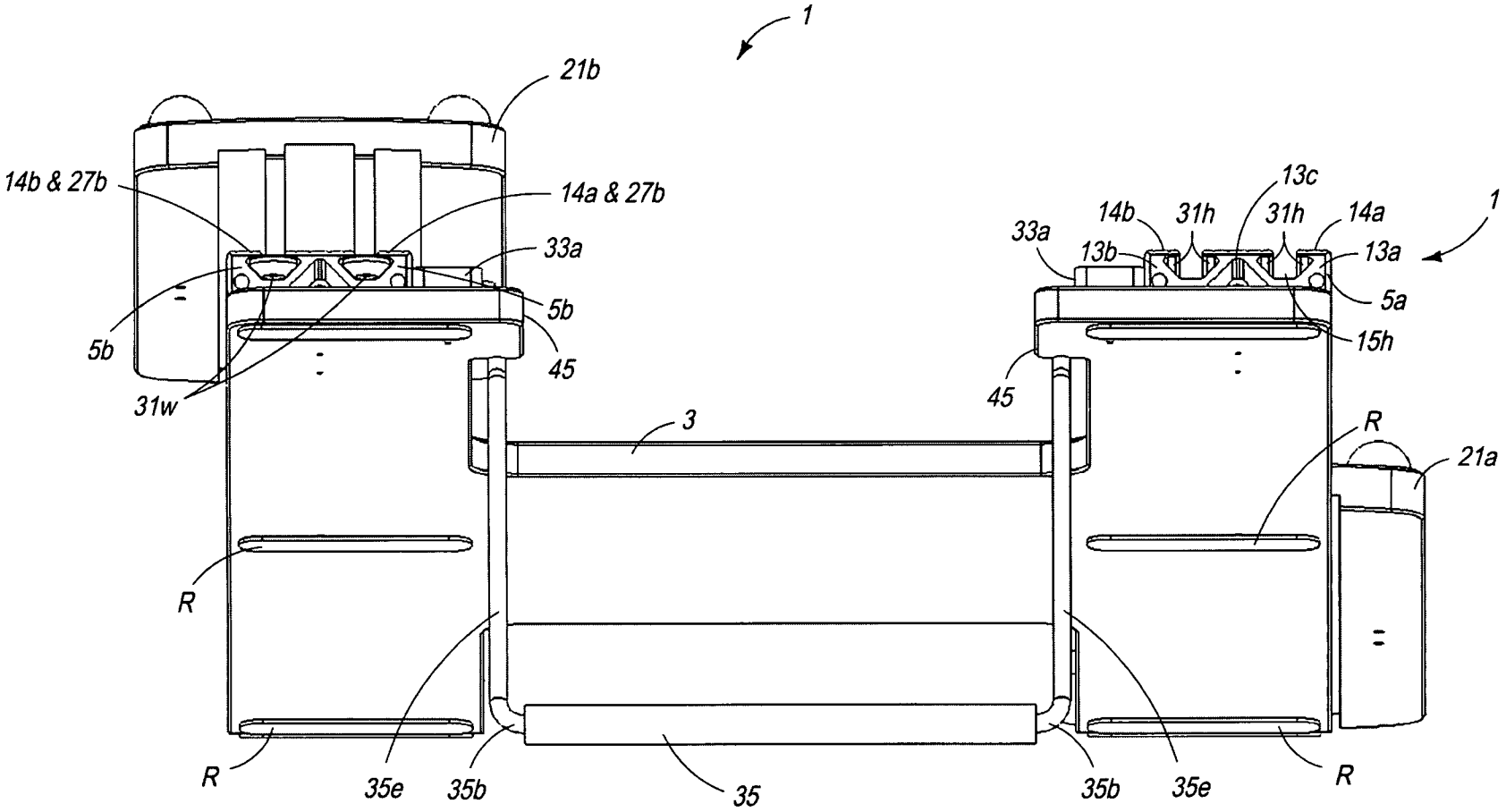
FIG. 2 is a close-up frontal view of the device shown in FIG. 1.
Figure 3:
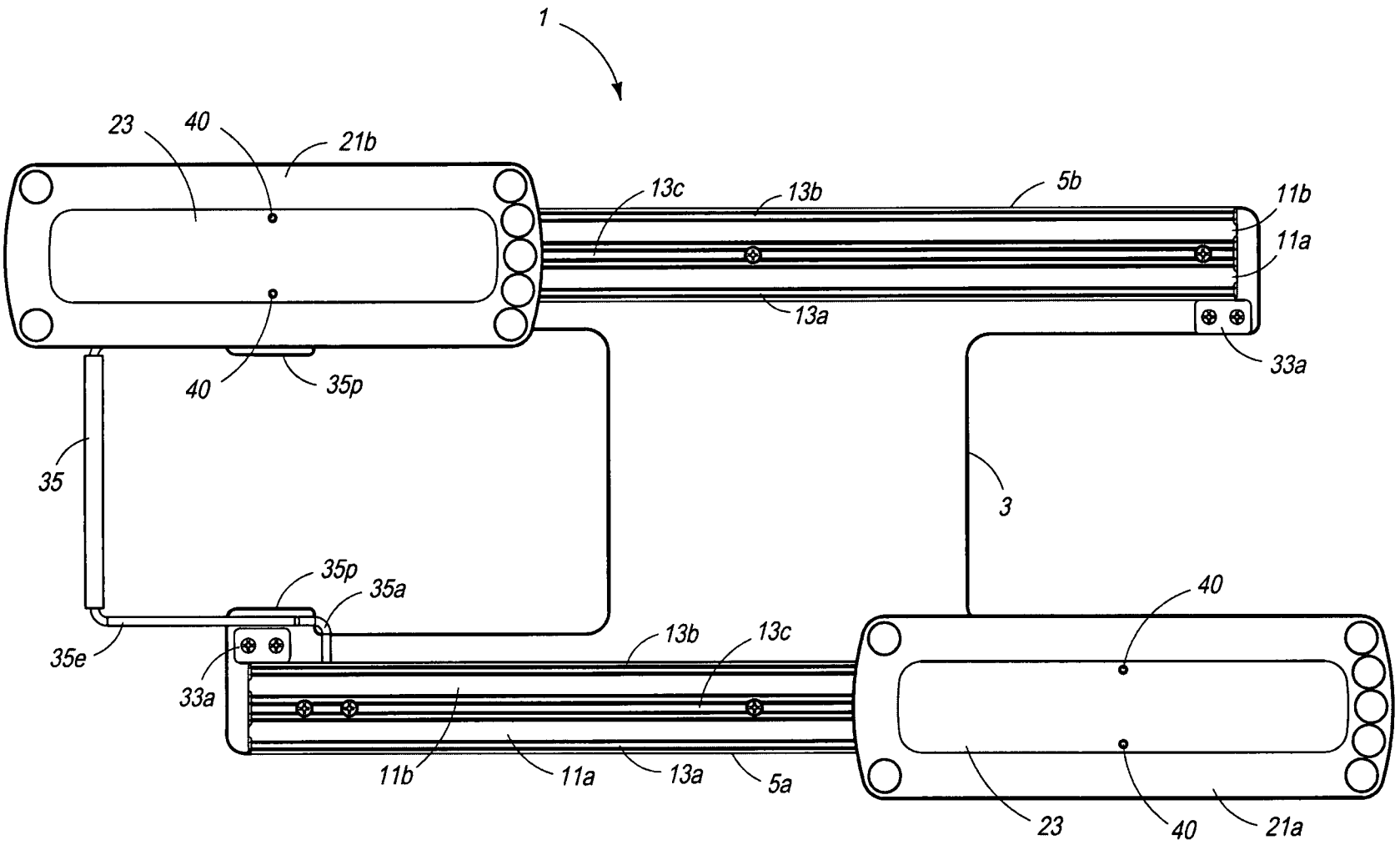
FIG. 3 is an isometric top view of FIG. 1 depicting the device in a carrying position.
Figure 4:
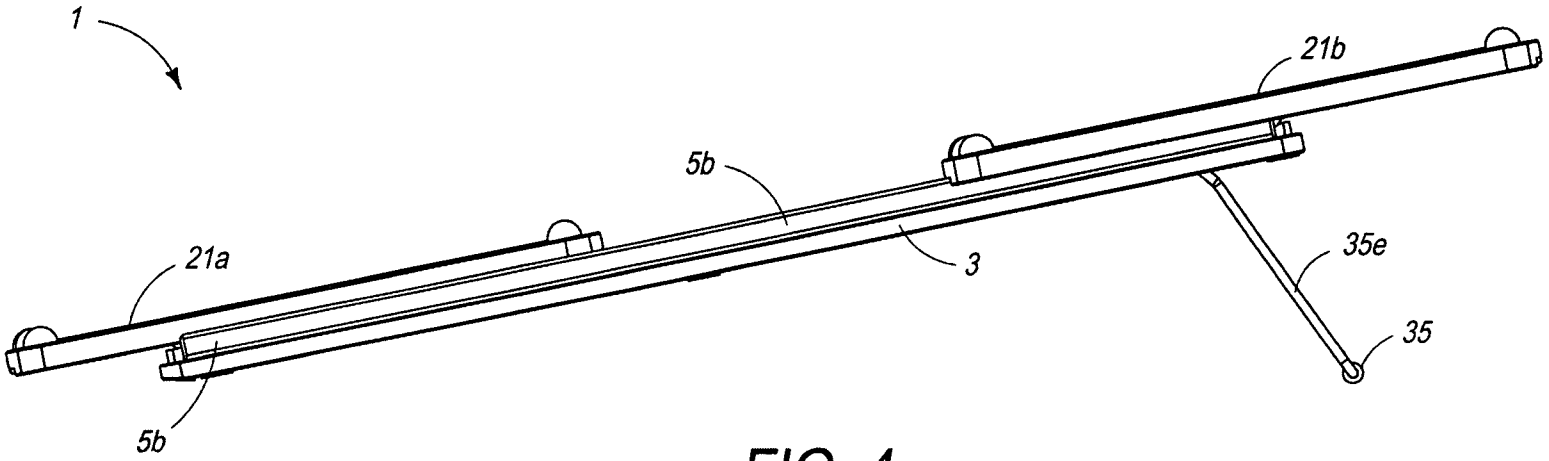
FIG. 4 is a side view of FIG. 1.
Figure 5:
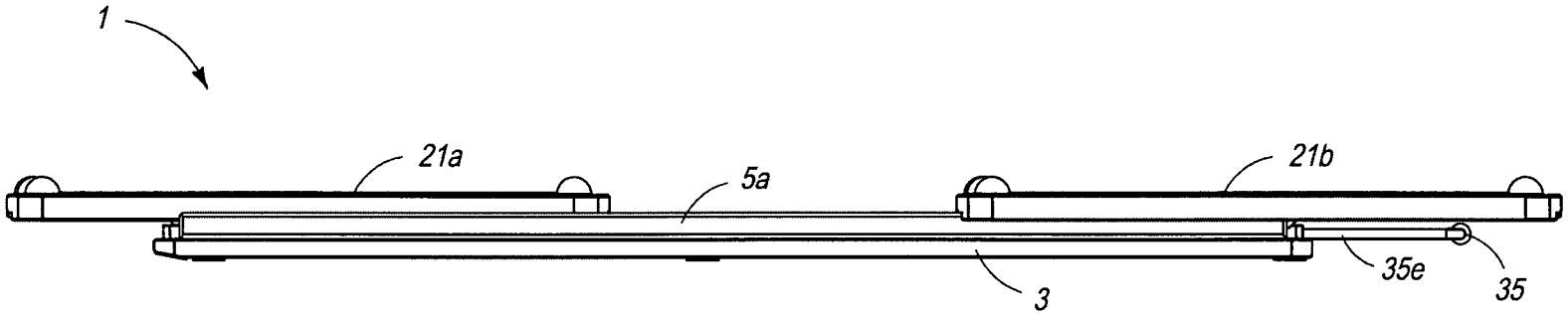
FIG. 5 is a side view of FIG. 3.

With reference to the Figures, the support platform 3 may be appropriately structured to support one or more guide rails 5 and foot plate 21. Any suitable means may be used to mount the guide rail 5 to the support platform 3. If desired, the platform 3 and the guide rail 5 may be of a single integrated piece of a unitary construction. Conventional mounting means such screws, bolts, glue, interlocking slides, buckles, heat sealing, rivets, welding, etc. may be used for mounting the guide rail 5 to the platform 3. A variety of rigid materials of a metal, wood, plastics such thermosets, composites, and thermoplastics, etc. construction may be used to fabricate the support platform 3. Materials of light and easily transportable weight afford benefits over those of a heavier construction. The flat support platform 3 as depicted in the Figures may be illustratively constructed of a high density polypropylene. A desirable light weight device 1 may be easily moved and used by therapy staff, health care providers and the patient. In order to prevent slippage, the underside of platform 3 may be equipped with anti-slip members R such as adhesively applied rubber patches. For a two footed device 1, the gross device weight will normally amount to less than seven (7) pounds and most typically within about the 3 to 5 pound weight range. This provides a convenient weight for use by patients, clinics, and hospitals. A one footed device 1 as depicted by FIG. 1 typically weighs about half the weight of the two footed device 1.

Although the use of slide surfaces 14 & 27 constructed of materials inherently possessing a low coefficient of friction provide highly effective and low strain therapeutic devices, the use of a lubricant or lubricating unit (generally referred as 40) may be effectively utilized to achieve the necessary or desired slide characteristics. Such lubricants 40 serve to effectively reduce friction between the foot plate slide surfaces 27 and the rail slide surfaces (e.g. 14*a* & 14*b*) even when used amongst those surfaces characterized as providing a very low coefficient of friction. Certain lubricants 40 may be directly applied as a lubricant coating onto the slide contacting surfaces (e.g. the foot plate slide surface e.g. 27*a* & 27*b*) or rail slide surfaces (e.g. 14*a* & 14*b*). Exemplary lubricant additives 40 possessing relatively desirable lubrication attributes include lubricants such as the hydrocarbon lubricants (e.g. greases, oils, etc.), the synthetic lubricants, wax lubricants (e.g. natural and synthetic waxes such as ski waxes) and polymeric lubricants graphite and the like. For example polymeric silicones conventionally serving as slip agents such those commercially available slip agents conventionally applied to the surfaces of granary bins, grain gravity boxes, etc. or talcum powder, macroscopic glass or wax beads (e.g. such as those used on shuffle board courts, etc.), graphite and such other similar lubricants are illustrative of those lubricants which may effectively serve to reduce friction. Lubricants 40 are not only useful for those surfaces exhibiting a high coefficient (high density polypropylene) but also for those possessing a highly desirable low coefficient of friction. Even amongst such exceptional low coefficient of friction plastics (e.g. such as a preferred high density molecular weight polyethylene) having about a 0.05 coefficient of friction without any lubrication can be effectively reduced by 40% or more (e.g. to about 0.030) by lubricating the tracking surfaces 14 & 27. This feature renders the device 1 even more useful for therapeutic treatments necessitating movement without requiring stressful movement.

For those lubricants failing to provide a long term lubrication by manual application to the slide engaging surfaces 14 & 27, a lubricating unit 40 may be directly incorporated into the device 1. FIGS. 1, 6-7, 10-12 and 14 depict a lubricating unit 40 which may be effectively utilized to apply the appropriate amount of liquid lubricant 40 (e.g. carried by wick 47) to the contacting slide surfaces 14 & 27. As may be observed by the Figures, a conduit 42 defined by the inlet and outlet lubricant conduits respectively (41 & 43) may effectively serve to continually deliver an appropriate amount of lubricant 40 through the foot plate 21 onto the interfacing sliding surfaces 14*a* & 14*b* of flanged rail guides 13*a* & 13*b* and slide surfaces 27*a* & 27*b* of foot plates 21*a* & 21*b*. The lubricating storing channel 42 may consist essentially of a foot plate 21 equipped with an oiling inlet aperture 41 an oil reservoir 47 (e.g. wick) for storing the lubricant 40 therewithin and a slide surface oiling outlet 43 (e.g. see FIGS. 10 and 12) which gradually deposits the lubricant 40 onto rail guide surfaces 14*a* &14*b*. Thus, as the foot plate 21 reciprocates upon rail 5, the lubricant dispensed by the lubricating unit 40 will be uniformly and gradationally spread onto the respective interfacing slide surfaces 14 & 27 and rail slide surfaces 14*a* & 14*b* by the lubricant as provided by lubricant unit 40.

The oiling or oil conduit 42 conducting a lubricating oil through a foot plate 21 lubricating port 41 to the top surfaces 14*a* & 14*b* of flanged rail slides 13*a* & 13*b* may be appropriately fitted with an oiling wick 47 constructed of an appropriate wicking material (e.g. felt, cotton, etc.) which serves as an oil reservoir or wick 47 for slowly releasing the lubricant onto the interfacing slide surfaces 14 & 27. Surprisingly a very small amount of lubricant of lubricant unit 40 (such as disclosed by the Figures) dispensed onto a rail guide surfaces 14*a* & 14*b* provides sufficient lubrication to maintain a desired coefficient of friction level for several months. This unique lubricating feature enhances slide and lessens the total amount of effort needed to place the foot plates 21 in a therapeutic motion while also affording the full range of joint motion as needed for therapeutic rehabilitation of an injured or replaced joint or other low stress therapy needs. Many therapeutic treatments demand motion and not stressful physical effort to achieve the desired treatment results. The use of lubricant can also effectively enhance durability and life cycle of the foot plate sliding surfaces 27.

In general, more effective joint rehabilitation for low stress applications may be effectuated by maintaining the coefficient of friction at a value of less than 0.08 with particularly enhanced efficacy being accomplished by using contacting slide surfaces 14 & 27 exhibiting a coefficient of friction of less than 0.06. Illustrative thereof and particularly effective for the more effortless motion treatments are those sliding surfaces 14 & 27 typically exhibiting a coefficient of friction ranging from about 0.02 to about 0.05.

The foot plates 21 need not necessarily be constructed entirely of a low coefficient of friction material. The advent of high molecular weight and high density plastics including those especially those polymeric compositions formulated so as to provide a low coefficient friction permits such low coefficient of friction materials to be a particularly useful source material for fabricating the foot plates 21 herein. In general, certain of these low friction materials also generally possess excellent machinability, extruding or molding characteristics for fabricating the foot plates 21 and/or the guide rails 5 herein including the foot plate retaining lip 31L. The foot plate retaining washers 31*w* may be appropriately configured for tracking use by molding (injection molding) stamped or cut from low coefficient from sheets or materials of a low coefficient of friction. Alternatively, inexpensive core materials and especially those of a light weight material may also be utilized to fabricate the foot plates 21 and guide rails 5 provided the contacting slide surfaces 14 & 27 collectively provide the appropriate desired low coefficient of friction values. Use of or base core materials is technically feasible since durable and effective synthetic coating materials possessing the necessary prerequisite low coefficient of friction values may be uniformly and tenaciously applied as a superficial coating or inlay onto a suitable supportive substrate. Such technique may be used to fabricate a foot plate 21 constructed of a solid piece of a low coefficient of friction material possessing excellent durability in maintaining desired coefficient of friction has been found to be most effective in providing a durable foot plate slide surface 14 & 27 when used in combination with a smooth plastic or metal rail 5. Screw heads coated with a low coefficient material to provide the foot plate retaining member 31*w* which may then be mounted to the bottom of tracking rib 29*a* & 29*b* as depicted in FIG. 10.

Certain plastics derived from closely related copolymerized monomers such as ethylene and homologs of closely related polyolefin thereto will often exhibit significantly different coefficient of friction values. For example, certain high density polypropylene may typically provide polymeric surface having a substantially higher coefficient of friction (e.g. greater than 0.1) than a more desirable low coefficient of friction possessed by certain of the high molecular weight polyethylene polymers. The compositional formulation of the polymeric material can play a significant role in its ultimate coefficient of friction properties. For example, certain plasticizers and slip agents formulated into the base polymer can significantly affect its coefficient of friction properties. Experience however, has shown that certain plastics extolled for their exceptional low coefficient of friction values and other desirable slip attributes often fail to yield the desired collective attributes when tested or applied to the therapeutic device 1 of this invention or when used as foot plate 21 herein.

Accordingly, testing of various different slide plate materials reveal certain plastics tend to perform poorly while others are much more effective in slide characteristics and more durable in performance. Plastics uniformly formulated with slip agents and plasticizers in combination with low coefficient of friction polymer tend to outperform and maintain their necessary low coefficient of friction character over prolonged periods of usage than those lacking such plasticizers and slip agents. In contrast, many other plastics will tend to lose the required low friction characteristics upon typical usage as normally required for therapeutic applications. Similarly certain other polymeric materials possess and maintain the desired friction attributes herein upon prolonged usage, especially those of an appropriate polymeric character when formulated with the appropriate slip imparting agents and plasticizers.

As mentioned herein, a particularly highly effective foot plate 21 construction material for fabricating the slide surfaces 27 herein has been found to be a plastic high molecular weight (polyethylene) material often used in the fabrication of bread and other cutting boards provided by VANCE Industries, Inc. (website sales @ vanceind.com, www.vanceind.com). This polymeric material (referred herein for convenience as VHMWPE) has a lubricating touch and feel while also maintaining its slip characteristics without evidencing any slip deterioration even upon prolonged usage. However, the use of the depicted lubricating unit 40 and lubricant (e.g. WD-40 or oil) effectively further serves to reduce its coefficient of friction from about 0.05 to about 0.03. This foot plate fabricating material in combination with the aluminum rail 5 depicted herein provides a highly desirable combined coefficient of friction value for use herein.

Figure 17:
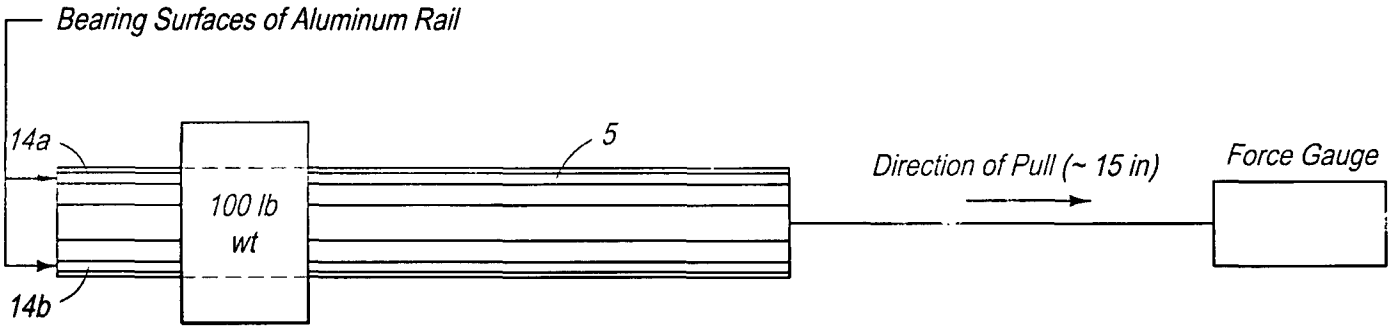
FIG. 17 depicts a schematic block diagram view of a measuring system for obtaining coefficient of friction data.

The coefficient of friction values may be determined by testing the sliding surfaces 14 & 27 efficacy herein using both the fabricated foot plate 21 and guide rail 5 stationarily mounted upon the platform 3. FIG. 17 depicts a schematic block diagram of the illustrative analytical testing method useful in obtaining the necessary data to determine the coefficient of friction values herein. A Mansfield and Green Force Gauge was used to determine force needed upon the tested therapeutic device 1 to slide the test foot plate 21 weighted with a one hundred pound weight at a 15-inch pull distance. The coefficient of friction determining formula is: $\mu=F/N$ wherein "$\mu$" represents the coefficient of friction, "F" equals Force and "N" represents the normal force. The formula and specifications for the coefficient of friction herein is more fully detailed in a publication entitled mechanical design book 1977© Published by McGraw-Hill.

The invention contemplates alternative device types which also includes a supportive platform, a guide rail and a foot plate slideably engaging thereupon parallel guide slots within a hollow housing for seating a rail retaining member thereto such as pointed out in our provisional application. Such a device with the operative counterparts of the accompanying Figure may include a positioned guide rail having two rail guides bordering the guide rail sidewalls with two slide surfaces slideably engaging onto slide surfaces of the foot plate with an innermost lip portion of the slide surface base of the foot slide extending onto housing to provide the structure for the foot plate retaining member. FIG. 23 of our provisional application depicts a device 1 in the form of cubed bottom section with a rail bed positioned along the sidewalls of the bottom section. The bottom section included slotted retaining members projecting inwardly above the bed which serves to retain a corresponding to sections having a slide surface mating slideably onto the bed and foot plate retaining member engaging onto a lower section retainer. This combination is designed to provide longitudinal tracking stabilization of the foot plate carried by the top section. As evident, there also exist other arrangements wherein the low coefficient friction of the guide rail 5 and foot plate 21, the foot plate retaining member 31 and the longitudinal stabilization of the tracking foot plate 21 may be achieved within the embodiments of the invention disclosed herein.

Many knee injuries caused by nerve damage due to strokes, ACL repair, and knee replacements or severely injured or weakened knees of the elderly or infirm require an extremely low level of strain initially before the knee is capable of undergoing more stressful and knee strengthening therapy. The same therapy considerations often applies to impaired arms. This therapy generally necessitates a gradual and slow increase in the stressful movement force over a relatively prolonged period. The present therapeutic device 1 can be readily adapted to meet such gradual and incremental increases in forces needed to move the foot plates 21. After initial low stress period of therapeutic treatment such as in a knee replacement has been effectively completed, the device 1 herein may be appropriately equipped with graduated or calibrated elevators positioned at the support platform frontal section (not shown). Elevation of the foot plate 21 and guide track 5 creating more stress may be effectuated by any suitable means of elevating or de-elevating the device 1. For example inserting elevating pegs near or onto the underside front end of the platform 3 will involve the level of stressful movement. The pegs may of a predetermined length for insertion into supportive front peg receiving apertures to provide the desired guide rail 5 incline for the particular rehabilitation stress level to be applied and required by the patient. More elevated inclinations may be achieved by using longer pegs in the same front platform end peg receiving apertures or by using the same pegs in combination with a plurality of rearward pegs receiving apertures (usually paired along the outer platform margins to provide support stability), forming a series of paired apertures progressively proceeding from the front platform underside and gradationally progressing towards the platform's underside mid-section. As the patient becomes stronger, the longer pegs may be inserted or the same length pegs may be moved backwards to the appropriate mating apertures to provide the necessary therapeutic stress treatment. Other calibrated friction creating devices may also be used, but may be more costly, complicated and may not provide the cost effectiveness of a single stage elevator or peg elevators. Similarly the platform 3 underside may be channeled crosswise to receive a rectangle bar stock insert (e.g. wood, plastic, etc.) mating onto the channel. To retain the bars within the channels clips, buckles, interfacing Velcro hooks and mats may be effectively used. Other elevating means may be used, however, the pegs and bar elevators provide an easy, low cost and effective means of gradually increasing the force needed to move the foot plates 21.

Figure 6:
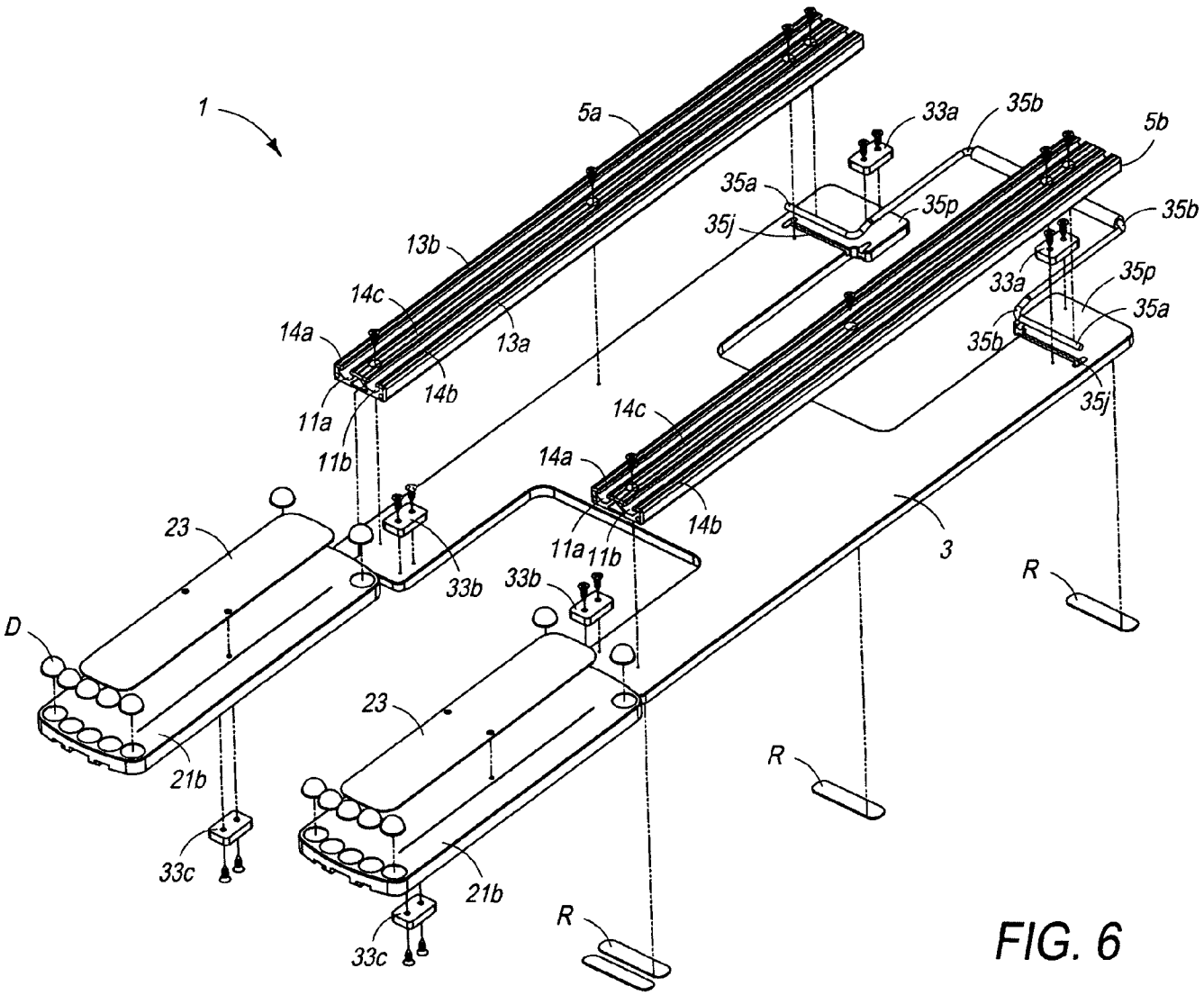
FIG. 6 is a top view of a disassembled device shown in FIG. 3.
Figure 7:
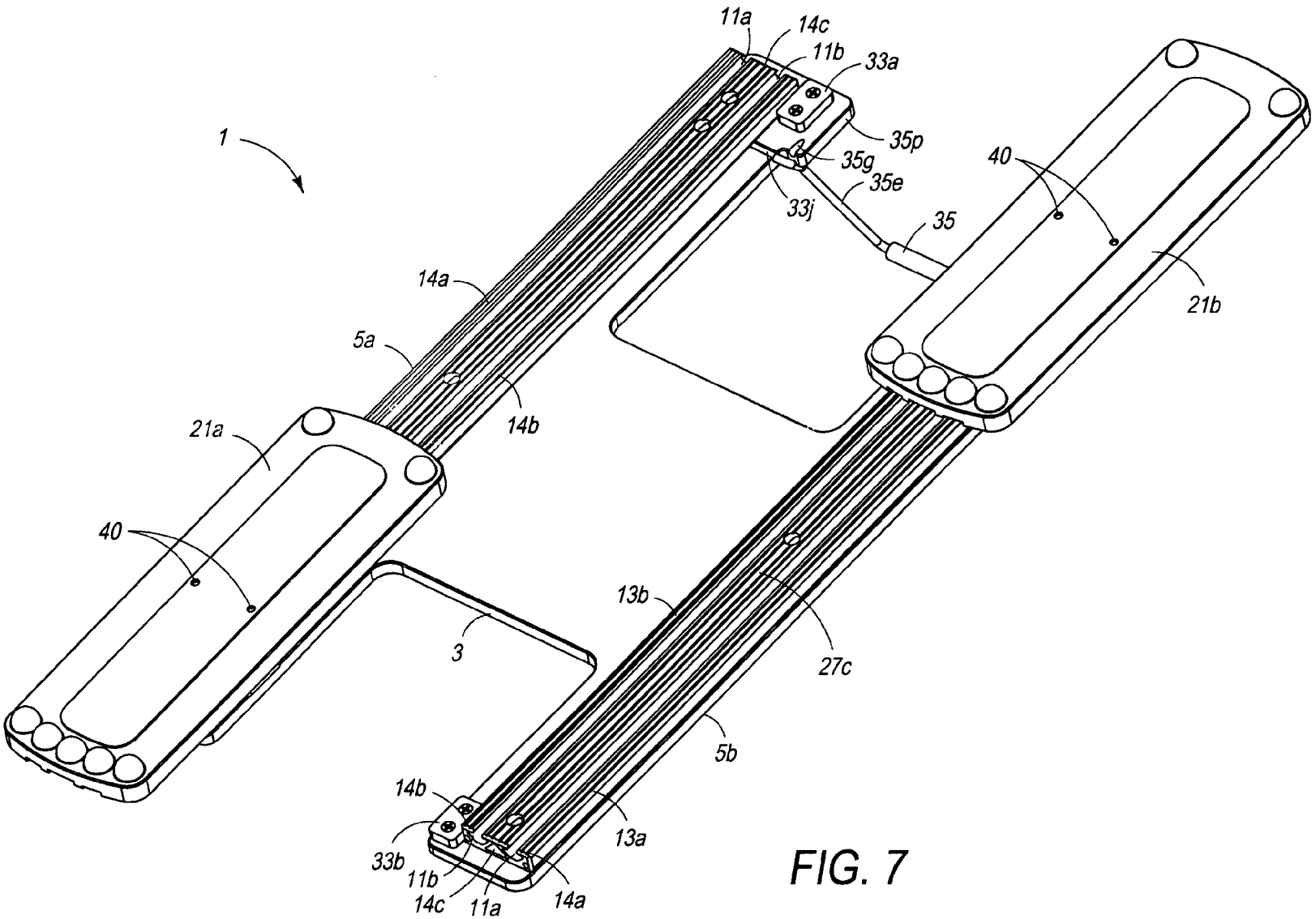
FIG. 7 is a rearward view of FIG. 1 depicting cross-sectional lines A-A and B-B.
Figure 8:
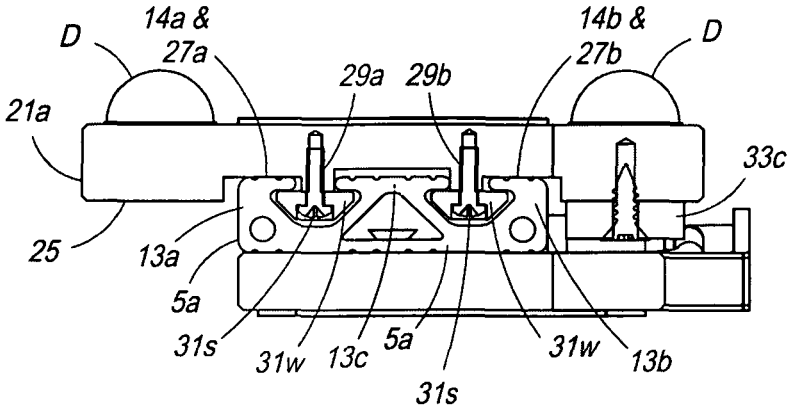
FIG. 8 is a cross-sectional view of the device taken along line A-A of FIG. 7.
Figure 9:
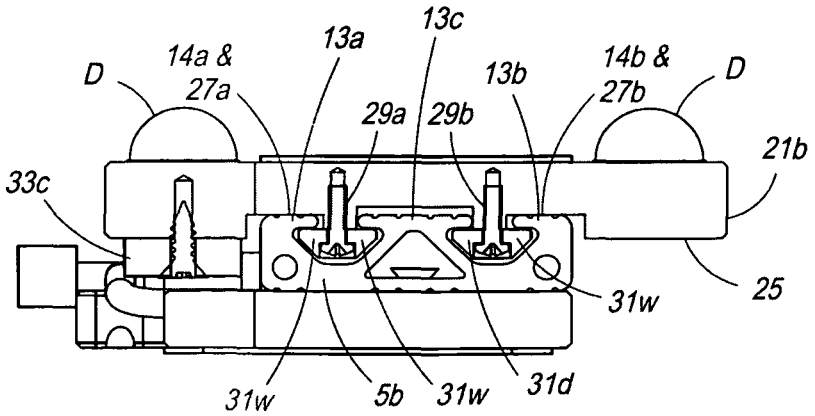
FIG. 9 is a cross-sectional view of the device taken along line B-B of FIG. 7.

The device 1 as shown in FIGS. 1-7, 11-12, and 14-16, provides a device 1 appropriately fitted with a carrying handle 35 and elevating legs 35*e* combination. The carrying handle 35 may be conveniently mounted to the platform 3 at a balancing position such as shown. The depicted handle 35 may be appropriately positioned to also serve as a base support for the elevating legs 35*e* of handle 35. The features of the elevating legs 35*e* and handle 35 combination may best visualized by the unassembled FIG. 6 view. It will be observed that a rectangular open space is provided in a centrally disposed forward portion of platform 3. This open space narrows at its mouth by inwardly projecting ledges 35*p*. The protruding platform ledges 35*p* serve as a stop and brace when the handle 35 and the elevating legged section 35*e* are placed in an elevated position as shown in FIGS. 1, 2, 4 and 7. Immediately trailing the protruding platform ledges 35*p* are axle journals 35*j* onto which axles 35*a* of the elevating leg 35 are journaled in axle journals 35*j*. Rails 5*a* & 5*b* serve to enclose axle 35*a*. It will also be observed from FIG. 1 this particular combination allows the handle 35 to freely counterrotate backward through the larger trailing open space. This also allows handle 35 to pivot about its restricted clockwise rotational path to its rotational stop and brace 35*p* as may be observed by FIGS. 2-7, 11, and 14-15. The positioning and mounting the handle axle 35*a*, the shape of the bends 35*b* and recessed slots 35*s* along the trailing edge of projecting ledge 35*p* as shown in FIGS. 1 and 7 allows legs 35*e* to rest atop of projection 35 in the carrying position as shown. A clockwise rotation places handle 35 in a carrying position as depicted by FIGS. 6 and 14. The pair of inwardly projecting ledges 35*p* thus serve as elevation stops against elevating legs 35*e* when the handle 35 is placed in an elevating position. Ledge 35*p* serves as a supportive brace for the carrying handle 35 when it is pivoted to the handle toting position. The sidewalls of platform 3 may be provided with other types of axle bearing sockets 35*j* bored into the platform 3 sidewalls to provide socket or journaled mounts. 35*j* for handle 35. The looped handle 35 and the elevating legs 35*e* terminated transversely positioned axles 35*a* pivotally journaled onto axle journal 35*j* as elevation at both of its terminating loop ends. The top side of platform 3 is provided with channeled journaled 35*j* which fully seat leg axle 35*a* within the confines of platform 3 and mounted rails 5*a* & 5*b*. The carrying handle 35 also includes an arcuate bends 35*b* (right angle) at the bending juncture of the looped carrying handle 35 and another pair of bends 35*b* in juxtaposition to the elevating leg 35*e* and axle 35*a* which allows handle 35 to longitudinally align with the main axis of the platform 3 when positioned in the carrying position and thereby provide a balanced carrying handle 35 for the device 1. The nesting of the legs 35*e* longitudinally in the carrying position is assisted by long longitudinal grooves in ledge 35*d*. When the handle 35 is rotationally pivoted rearwardly through the open space onto the forwardly projecting platform ledges 35*p*, the leg 35*e* rest against trailing edges of ledges 35*p* to seat the carrying handle 35 and elevating legs 35*e* at an elevated position for therapeutic use an opposite rotation places it in the carrying position.

Unexpectedly, the present invention affords an unexpected benefit in the therapeutic treatment to stroke victims. In stroke victim therapy, it is often necessary to use the stroke victim's unaffected leg or appendage to provide locomotive therapy for the stroke affected leg. This therapy is typically conducted in a seated position with both legs of the patient being bound together. Surprisingly strapping both of the foot plates 21 or leg binding is unnecessary with the present device 1. The need for such binding or both foot plates 21*a* & 21*b* may be avoided simply by flipping platform 3 over so it serves as a foot support for both of the victim's feet and allowing the foot plates 21 to rest on the floor. This allows the healthy leg to lead and provide therapeutic treatment to the physically incapacitated or paralyzed leg. The two foot plate device affords greater stability than the one foot plated device when used for this purpose. The same therapy procedure may also be applied to stroke victims with an impaired arm and a healthy arm.

Providing a therapeutic device 1 having foot plates 21 which in combination with a guide rail 5 exhibiting a tracking coefficient of friction of less than 0.1 and particular those are less than 0.07 is not an easy task without undertaking the appropriate precautions being taken. Using the aluminum guide rail 5 described herein, the combined coefficient of friction values between the foot plate 21 and guide rail 5 (e.g. see FIG. 4) may be readily determined. As previously mentioned many plastic formulations extolled as having an extremely low coefficient of friction, outstanding strength, and allegedly possessing self-lubrication attributes may unfortunately actually fail to meet the testing efficacy for the device 1 of this invention. Illustrative thereof is a commercially available plastic material touted as a virgin, ultra high molecular weight polyethylene possessing all of the apparent desired attributes, but unfortunately this material when tested fails to provide an unacceptably high coefficient of friction rating of 0.14-0.19. However, when fitting of the foot plates 21 and the device 1 with the lubricating unit 40, the coefficient of friction values of certain unacceptable materials may be sufficiently reduced to an acceptable use level. These lubricating features are also effective to enhance durability and useful foot plate life. A high density high molecular polyethylene commonly used as a bread board and cutting board unexpectedly exhibits exceptional efficacy and performance attributes as a foot plate 21 material and slide surface 27. This exceptional foot plate material is sold and distributed by Vance Industries, Inc., 5617 West Howard Street, Niles, Ill. 60714. This particular high molecular weight polyethylene material yields a surprising 0.05 coefficient of friction without requiring any lubricants and an even more outstanding a 0.031 coefficient of friction value when lubricated with a conventional motor oil dispensed by a lubricating unit 40 as depicted in the Figures.

In the unmodified or modified form, the foot plate sliding surfaces 27*a* and/or 27*b* sliding upon the rail contacting surfaces (14*a* and/or 14*b*) collectively effectuate the prescribed coefficient of friction values herein upon operational use. For most patients in the very early stages of recovery, the therapeutic device 1 is capable of providing foot plates 21 which track upon the aluminum rail guide 5 surfaces (14*a* and/or 14*b*) by creating less than a 0.07 coefficient of friction value. In order to effectively serve stroke patients with a rehabilitated leg, an ACL repair or knee replacement, particularly effective recovery results may be achieved by using the device 1 rated as having an operational coefficient of friction ranging from about 0.2 to about 0.05. As may be observed by the Figures the invention provides a highly effective therapeutic device 1 of the compact and low profile features which contrasts with the extremely bulky and stressful prior art units. The exceptional light weight, ease of placement for use and the versatility and its effectiveness in therapeutic treatment makes both single foot plate 21 and double foot plate 21 units highly useful by patients for in home treatment, or at clinics, therapeutic and health centers, chiropractic facilities, hospitals, as medical rentals, etc.

Figure 15:
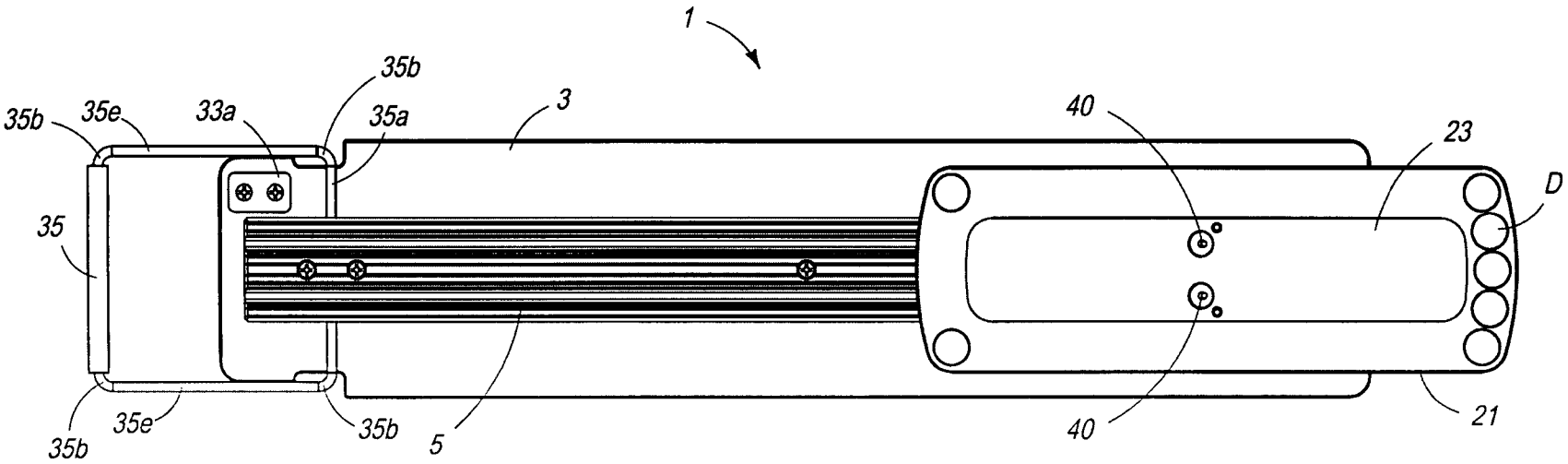
FIG. 15 is a top view of the device shown in FIG. 11.
Figure 16:
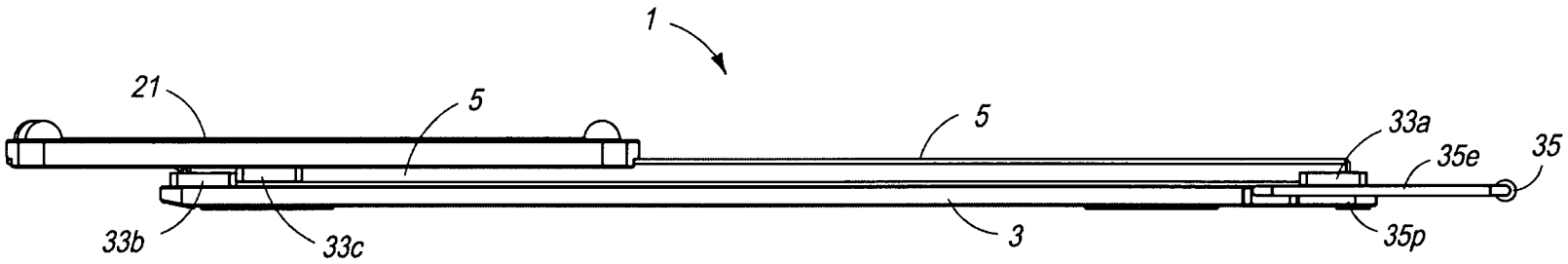
FIG. 16 is a side view of FIG. 15.

The therapeutic treatment provided by the present device 1 generally applies to jointed appendages which includes arms, hands, wrists, elbows, shoulders, forearms, upper arms, toes, etc. as well as all of the body parts associated with leg therapy from the hip joint down. As may be observed, FIGS. 1-7 depict therapeutic devices 1 equipped with multiple rails 5 and foot plates 21 whereas FIGS. 11-12 and 15-16 depict a single rail 5 carrying a single foot plate 21. FIGS. 14-16 depict what may be referred to as a mono-railed device 1 served by one rail 5 and one foot plate 21. The mono-railed device 1 is equipped with the depicted washered retaining member 31*w* and the lipped retaining member 31L. The component parts and method of use of the mono-railed device 1 are similar to the two railed device 1. The device 1 is generally seated for use in treating a single patient appendage as the two foot plate device 1. The single foot plate unit 21 can be used for therapy involving one foot or an arm with the device 1 being suitably placed upon an elevated site such as a table for the convenient use by the patient.

The foot plates 21 may be provided with a recessed top surface which serves to help seat the foot placed thereupon within the recess. A foot plate pad 23 may also be used to maintain foot contact with foot plate 21. These features also helps to maintain the foot seated within the depression at a tracking position. The projecting decorative plastic attachments designated by D shown in the Figures also serve a similar purpose in facilitating and maintaining the foot in an appropriate exercising foot plate position while also creating a decorative foot plate 21 appearance. It may be further observed from FIG. 6, that slip resistant pads R such as rubber pads R may be installed upon the platform 3 to prevent platform slippage during use.

Although the device 1 includes features which afford a relatively effortless range of motions most appropriate for certain therapeutic uses, the device 1 also embodies features which may be effectively utilized to increase the level of exertion needed to move the foot or the appendages plates 21. Accordingly by elevating the foot plates 21, the level of exertion needed to move a foot plate 21 may be correspondly increased to a desired level for certain therapeutic needs. Foot plate 21 elevation may be accomplished by a host of elevational system as previously pointed out. Also by positioning of the elevated foot plates 21 in an inclining or declining position can dramatically affect the particular type of therapeutic treatment administered to a patient. The positioning of the appendages tracking upon the foot plate 21 will have a therapeutic effect upon the appendage body parts receiving the brunt of the exercising treatment. For example, a foot exercised upon an inclined exercising device 1 will emphasis joint and muscular treatment which simulates walking. Conversely exercising a foot with the device 1 positioned in a declining position will tend exercise those muscles and joints normally being exercised in a downhill exercise. Thus an exercise upon a device 1 positioned in a declining position will emphasis therapeutic treatment of ham string muscles.

EXAMPLE

A therapy device 1 uniquely designed for providing active and passive range of motion exercise to one or both knees and ankles in a seated position or back lying position was made in accordance with the teaching herein. The device may be used in flat, declining, elevated or upside down position to create a desired movement for a specific muscular or skeletal region. The device 1 as depicted by the Figures provides independent movement of one leg from the other leg creating an alternating motion in sagittal plane or both legs can be moved together. The device 1 was constructed to provide a low profile or less than 1½ inches high, 22 inches long, and 12 inches wide. This provide a safe therapeutic device having an extremely low center of gravity by maintaining the profile at less than three inches (i.e. height) and particularly less than two inches provides significant therapeutic safety in preventing patient users from falling from the device is substantially diminished. This feature is important to the elderly and recent surgery patients who inherently have difficulty in maintaining balance. The foot plates 21 in this example measured 4 inches wide by 12 inches in length, and were made for comparative purposes of a polypropylene stock and another of a polyethylene stock both of which were machined to slide upon the aluminum rail 5 as described herein. The foot plates 21*a* & 21*b* were machined with a conventional wood router to the specifications as designated by the engineering drawings filed with our provisional application. The aluminum rail measured 2 inches wide, 21 inches long with three flanged surfaces 13*a*, 13*b* & 13*c* on each rail 5, one center track (13*c*) % inch wide, and the two outside tracks (13*a* & 13*b*) of a ¼ inch thickness. The rail bearing surfaces are "plane bearings" constitute the two outer surfaces (14*a* & 14*b*) of flanged rails 13*a* & 13*b* of the rail 5 and an inner % inch surface 14*c* due to foot plates 21*a* & 21*b* were machined so that the inner rail

14*c* had no surface to surface contact with the contacting surfaces of the foot pad 21. The guide rail 5 (commonly available from Home Service Centers for use as a sliding door rail) as depicted in the Figures was procured from John Henry Foster, 3103 Mike Collins Drive, Eagen, Minn. 55121.

Tests were performed for coefficient of friction of the plane bearing the surfaces for the machined polyethylene (VHMWPE) and polypropylene foot plates 21 upon the above mentioned aluminum guide rail 5 of this example using the testing device depicted by the schematic block diagram of FIG. 17 to ascertain the coefficient of friction values. The coefficient of friction determinations for the polypropylene foot plate 21 was performed on a dry rail surface registered a coefficient of friction of 0.155. By the spraying "WD-40" lubricant upon the interfacing slide surfaces of outside tracks 13*a* & 13*b* the coefficient of friction thereof was reduced to 0.085. The coefficient of friction with the polyethylene foot plate material (i.e. The VHMWPE as mentioned herein) was initially performed on a dry plane bearing surface and then "WD-40" lubricant being added to the rail surfaces 14*a* & 14*b* of rails 13*a* & 13*b*. This polyethylene material (VHMWPE) registered an exceptionally low coefficient of friction of 0.051 dry (without any rail lubricant) and with a lubricating film of "WD40" lubricant applied to the interfacing surfaces of rail bearing surfaces 14*a* & 14*b* the coefficient of friction was then reduced to 0.031.

With particular reference to Figures the grooves machined into the plastic footplates 21 are such that the vertical bearing surfaces 14*a* & 14*b* serve to minimize movement in the lateral direction keeping the foot plate 21 in a sound linear plane without experiencing any excessive lateral movements. The two shoulders or legs 35*e* (machined on the bottom side of the foot plates 21 shown in FIGS. 12 and 13) prevented the foot plates 21 from moving in a vertical direction so as to maintain a sound stable foot plate 21 such that the users foot can be placed on any location of the foot plate 21 without tipping foot plate 21 or becoming dislodged when transported. The resultant device 1 is very light weight (approximately 5 lbs) making it very easy to pick up and move around in home, clinic, or transporting in a vehicle or suitcase. A schematic block diagram depicts a top view of the apparatus and test conditions. The test material M indicated by phantom lines was placed in contact with rail contacting surfaces 14*a* & 14*b* with a 100 pound covering weight placed weighing the test material M.

Therapeutic Device 1
Guide Rail 5
Support platform 3
Parallel guide slots 11*a* & 11*b*
Flanged slide guides 13*a* & 13*b*
Center flanged 13*c*
Housing cavity 15*h*
Foot retaining member 31
Rail retaining member 31
Foot plate 21
Foot plate underside 25
Foot plate slide channels 26*a* & 26*b*
Recessed slide surface 27/27*a* & 27*b*
Contacting rail surfaces 14/14*a* & 14*b*
Tracking ribs 29*a* & 29*b*
Movement stop 33
Forward stop 33*a*
Rearward stop 33*b*
Foot plate stop 33*c*
Retaining lip 31L
Retaining flanged section 31*h*
Retaining washers 31*w*
Lubricant wick 47
Lubricating channel inlet 41
Lubricating channel outlet 43
Lubricating unit 40
Carrying handle 35
Elevating legs 35*e*
Ledge stop 35*p*
Journaled axle 35*j*
Axle 35*a*
Arcuate bends 35*b*
Lubricant conduit 42
Decorative attachments D
Test material M
Rubber pads R

What is claimed is:

1. A therapeutic exercising device adapted to minimize frictional forces as an appendage of an exercising patient tracks thereupon, said device comprising:

A) a supportive platform;

B) a slideably engaged foot plate equipped with at least one underside foot plate tracking surface;

C) a guide rail supported by said platform and having at least one longitudinally guide rail tracking surface slideably engaging onto the foot plate tracking surface;

D) at least one longitudinally aligning member for retaining the foot plate in longitudinal alignment with said guide rail as the foot plate reciprocates upon said guide rail and, E) at least one stopping member for stopping the forward and rearward motion of said foot plate upon said guide rail.

2. The device according to claim 1 wherein the foot plate tracking surface and the guide rail tracking surface operationally provide a coefficient of friction of less than 0.1.

3. The device according to claim 2 wherein each foot plate includes at least two interfacing guide rail tracking surfaces and a corresponding number of foot plate tracking surfaces, the coefficient of friction is less than 0.07 and the foot plate including the longitudinal alignment member and retaining member are fabricated together as a single piece of construction for a high molecular weight plastic material.

4. The device according to claim 1 wherein the foot plate includes a pair of longitudinally extending ribs tracking within longitudinal slots provided the rail.

5. The device according to claim 4 wherein the interfacing guide rail surfaces and foot plate tracking surface are equipped with a lubricating unit for depositing a lubricant therebetween.

6. The device according to claim 5 wherein the operational coefficient of friction for the device ranges from about 0.02 to about 0.05.

7. The device according to claim 1 wherein the device includes two foot plates individually tracking upon two guide rails having two longitudinal stabilizing slots extending lengthwise and each foot plate carries two longitudinal ribs tracking within said slots and each rib carries an overhanging retaining member to retain the foot plates within said slots.

8. The device according to claim 1 wherein the device includes a single foot plate tracking upon a single guide rail.

9. The device according to claim 1 wherein the longitudinal aligning member comprises a pair of downwardly projecting tracking ribs each equipped with a rail retaining member and the guide rail includes at least two longitudinally extending guide slots for individually and correspondly receiving and retaining the pair of tracking ribs therewithin with each of said guide slots being positioned in parallel longitudinal alignment and having an internal cavity of a greater width than an individual width of each of the slots and each of the slots having a retaining flanged section which serves to retain the rail retaining member carried by said ribs and the foot plate is fabricated from a high molecular weight polyolefin having a coefficient of friction of less than 0.07.

10. The device accordingly to claim 1 wherein the guide rail includes two longitudinal parallel slots each housing therewithin an internal cavity with each opening of the slots being bordered by an outer flanged section and a center flanged section of an equal dimensional height and the underside of each foot plate includes two slide engaging channels of sufficient depth to interfacially slide along each outer flanged section with the foot plate underside in juxtaposition to the center flanged section being recessed to a deeper depth so as to avoid interfacial contact therewith and thereby create slide tracking upon each outer flanged section.

11. The guide rail according to claim 10 wherein the guide rail is of an aluminum construction.

12. The device according to claim 10 wherein each foot plate is constructed of high molecular weight polyethylene and of a high density tracking of the foot plate upon the guide rail provides a coefficient of friction value ranging from about 0.02 to about 0.05.

13. A therapeutic exercising device adapted to provide a minimal level of frictional resistance as an appendage of a patient tracking the appendage upon the device, said device comprising:

A) a support platform for supporting the device;

B) a guide rail mounted to the support platform with said guide rail having a plurality of parallel guide slots longitudinally extending along the guide rail and flanged slide guides margining along an upper margin of the guide slots to form a flanged hollow housing for seating a foot plate retaining member therewithin;

C) a foot plate having an upper surface for placing an appendage of the patient thereupon and a foot plate underside having a pair of recessed slide surfaces for slideably tracking upon at least two of the flanged slide guides and a plurality tracking ribs longitudinally tracking within the guide slots so as to maintain a longitudinal alignment and tracking of the foot plate as the foot plate reciprocates along said flanged slide guides and the retaining member is slideably carried by the tracking ribs within the flanged hollow housing of guide rail so as to retain for the foot plate to the rail; and D) positional stops for stopping a forward movement and a rearward movement of the foot plate upon said guide rail.

14. A method of using a therapeutic device for a desired therapeutic treatment by a patient, said method comprising:

A) providing a therapeutic device comprising:

a) a supportive platform;

b) a slideably engaged foot plate equipped with at least one underside foot plate tracking surface;

c) a guide rail supported by said platform and having at least one longitudinally guide rail tracking surface slideably engaging onto the foot plate tracking surface;

d) at least one longitudinally aligning member for retaining the foot plate in longitudinal alignment with said guide rail as the foot plate reciprocates upon said guide rail and, e) at least one stopping member for stopping the forward and rearward motion of said foot plate upon said guide rail, B) placing the device in a therapeutic position to allow the patient to conduct an appendage therapy with said device;

C) conducting the desired therapeutic treatment by placing an appendage to be treated upon the device while reciprocating the appendage in a reciprocating movement upon said foot plate and;

D) discontinuing the therapeutic treatment after a desired period of the therapeutic treatment has been completed.

15. The therapeutic method according to claim 14 wherein the provided device has an operational tracking coefficient of friction of less than 0.10 and the appendage therapy comprises leg therapy and the method includes placing the foot of the patient upon a desired foot plate and allowing a foot of the patient to reciprocate thereupon for the desired period of treatment.

16. The device according to claim 15 wherein the device includes a lubricating unit for introducing a lubricant between the foot plate slide surface and the guide rail tracking surface and the method includes the introducing a lubricant to the lubricating unit.

17. The method according to claim 14 wherein the platform of the device includes an elevating member for elevating the platform to increase foot plate resistance and the method includes elevating the platform with said elevating member.

18. The method according to claim 15 wherein the elevating member includes gradational elevating members for gradationally increasing the incline of platform and the method includes periodically increasing the incline of the platform by gradationally changing the elevating members to change the incline thereof.

19. The method according to claim 15 wherein the therapeutic treatment of the patient involves an appendage substantially impaired to muscular movement and the method includes flipping the device over from its normal operational position so that the foot plates engage onto a supportive floor and the platform tracks upon the guide rail tracking surface thereby permitting a muscular unimpaired appendage of the patient to provide a tracking movement thereupon and thereby permit a therapeutic exercise of the impaired appendage.

20. The method according to claim 14 wherein the method of providing includes fabricating the foot plate from a solid high molecular weight plastic material having a coefficient of friction of less than 0.07 machining an underside of each foot plate to provide a pair of longitudinally extending recessed channels for correspondly mating onto an outer pair of flanged guide sections of said flanged guide rail and the plurality of tracking ribs comprise a pair of longitudinal extending ribs mating onto a pair of longitudinal slots bordering the outer pair of flanged guide sections, with said ribs being of sufficient length to penetrate into a hollow cavity positioned housed by the flanged guide sections and a retaining outwardly lip at a terminal end of each rib positioned so as to overhang and clear the underside of the flanged section.

21. The method according to claim 20 wherein the method includes the providing of a lubricating unit equipped with a conduit for conducting a lubricant through the foot plate onto each pair of the recessed channels and the method includes applying a lubricant to the lubricant unit.

* * * * *